US006069311A

United States Patent [19]

Hiramatsu

[11] Patent Number: 6,069,311

[45] Date of Patent: May 30, 2000

[54] ELECTRONIC MUSICAL INSTRUMENT HAVING MOTHER BOARD COMMUNICABLE WITH PLUG-IN BOARD

[75] Inventor: Mikihiro Hiramatsu, Hamamatsu, Japan

[73] Assignee: Yamaha Corporation, Hamamatsu, Japan

[21] Appl. No.: 09/082,739

[22] Filed: May 21, 1998

[30] Foreign Application Priority Data

May 22, 1997 [JP] Japan ..... 9-132656
May 22, 1997 [JP] Japan ..... 9-132658
May 22, 1997 [JP] Japan ..... 9-132659

[51] Int. Cl.[7] ..... G10H 5/02

[52] U.S. Cl. ..... 84/659; 84/618; 84/622; 84/656; 84/659; 84/DIG. 2

[58] Field of Search ..... 84/601–602, 618, 84/622–633, 655, 656, 659–661, 662–665, 477 R, 478, DIG. 2

[56] References Cited

U.S. PATENT DOCUMENTS 4,783,812 11/1988 Kaneoka ..... 381/61
5,750,913 5/1998 Kamiya ..... 84/625
5,760,326 6/1998 Ishibashi ..... 84/626

*Primary Examiner*—Robert E. Nappi
*Assistant Examiner*—Marlon T. Fletcher
*Attorney, Agent, or Firm*—Graham & James LLP

[57] ABSTRACT

An electronic musical instrument is constructed on a mother board for editing a parameter of an extension board necessary for generating a music tone while monitoring the parameter according to display information. In the instrument, a display device is provided for displaying a current value of the parameter to be edited. An input device is operable for inputting an operational variable effective to change the current value of the parameter. A first control circuit contained in a CPU of the mother board is operative when receiving the display information for controlling the display device to display the current value of the parameter, and is operative when the operational variable is inputted from the input device for transmitting the operational variable to the extension board. A second control circuit composed of a CPU and a RAM is provided in the extension board for memorizing the current value of the parameter so as to generate the music tone, and is operative when the operational variable is transmitted from the first control circuit for updating the current value of the parameter and for transmitting back the display formation indicative of the updated value of the parameter to the first control circuit so that the first control circuit of the mother board can control the display device to display the updated value of the parameter of the extension board.

27 Claims, 8 Drawing Sheets

SOUND SYSTEM
200
D/A
105
DSP
104
RAM
103
SERIAL I/O
107
MIXER
106
ROM
102
100
ANALOG IN
TERMINAL
110
A/D
109
MUSIC TONE GENERATOR
108
CPU
101
199
CPU
RAM
ROM
EFFECTOR
CONNECTOR
CONNECTOR B
129
BUS LINE
115
TIMER
111
DISK
180
MOTHER BOARD
191
CPU
RAM
ROM
ONE-PART SOUND SOURCE
CONNECTOR
CONNECTOR A
121
I/O
112
DISK DRIVE
170
116
MIDI OUT
TERMINAL
119
DRIVER
120
SERIAL I/O
I/O
113
DISPLAY DEVICE
160
MIDI IN
TERMINAL
118
PHOTO-COUPLER
117
I/O
114
OPERATOR PANEL SWITCH
150

ELECTRONIC MUSICAL INSTRUMENT HAVING MOTHER BOARD COMMUNICABLE WITH PLUG-IN BOARD

BACKGROUND OF THE INVENTION

1. Field of the Invention

The present invention generally relates to a tone synthesizing apparatus and a tone parameter setting apparatus suitable for use in an electronic musical instrument.

2. Description of Related Art

In a known electronic musical instrument, a variety of plug-in boards can be attached to a mother board of a main frame of the electronic musical instrument. In personal computers also, a variety of plug-in boards can be attached to the mother board of the main frame. In personal computers, after inserting a plug-in board, it is a general practice to install driver software from a CD-ROM or a floppy disk for operating the inserted plug-in board. Like personal computers, an auxiliary storage device such as a CD-ROM drive or a floppy disk drive may be attached to electronic musical instruments. However, increased cost prevents many of electronic musical instruments from installing the auxiliary storage device. Therefore, a serious problem lies in that a plug-in board having capabilities that have not been supposed at designing the main frame of the electronic musical instrument cannot make the use of or at least cannot make the most of these capabilities of the plug-in board.

As described above, there are known electronic musical instruments in which a variety of plug-in boards can be attached to the mother board of these electronic musical instruments. The mother board herein denotes a main circuit board installed on an electronic musical instrument beforehand. If no plug-in board is attached, the mother board may simply provide basic capabilities. On the other hand, a plug-in board is attached to the mother board afterward to provide capabilities additional to these basic capabilities. For example, a plug-in board provides a tone generator that can create a timbre by an algorithm of higher level than that of the mother board. When performance information such as a MIDI signal is externally supplied to the mother board while such a plug-in board is attached, the mother board determines which of the mother board and the plug-in board should treat this performance information. This decision is implemented by memorizing the name of the board by which the sounding is to be made into a table beforehand in correspondence with timbre names, for example. Needless to say, only the performance information to be sounded by the plug-in board is supplied to the plug-in board. However, according to the above-mentioned technology, the decision in the mother board must be made before the supplied performance information reaches the plug-in board, so that the arrival of this information involves some delay. This causes a timing deviation between sequential music tones, thereby presenting a problem of adversely affecting the music tones.

An electronic musical instrument is known, in which a variety of plug-in boards can be attached to the mother board of the main frame through extension slots. The mother board is a main board installed in the electronic musical instrument beforehand. If no plug-in board is attached, the mother board provides basic capabilities alone. The plug-in board can be additionally attached to the mother board, providing capabilities additional to the basic capabilities of the mother board. For example, a plug-in tone generator board increases the number of timbres that can be sounded. A plug-in effect board increases the number of selectable sound effects. However, in the conventional electronic musical instruments, the extension slots for installing plug-in boards are each dedicated to a tone generating board or an effect board. Therefore, it is impossible to freely insert a plug-in board in arbitrary one of the extension slots. In contrast, in personal computers, a plug-in board can be inserted in any extension slot. The plug-in board thus inserted can be operated by driver software installed from a CD-ROM or a floppy disk. It would be also practical for electronic musical instruments to have the common extension slots similar to those of personal computers. However, this presents a problem of increase in fabrication cost. Further, a sound generating system is typically composed of a block for generating tones, a block for mixing generated tones, a block for imparting an effect to the mixed tones and other blocks, thereby making it difficult to insert a plug-in board freely at desired position of the tone generating system.

SUMMARY OF THE INVENTION

It is therefore a first object of the present invention to provide an electronic musical instrument capable of making the most of the capabilities of attached plug-in boards.

It is a second object of the present invention to provide a tone synthesizing apparatus capable of generating tones with proper timing.

It is a third object of the present invention to enhance general versatility of extension slots and to increase degree of freedom of a tone generating algorithm.

According to a first aspect of the invention, the music apparatus is constructed on a mother board, and is responsive to performance information for generating a music tone having a desired timbre according to timbre setting information. In the music apparatus, an input terminal is provided for inputting performance information. A control circuit is disposed on the mother board, and is operative when the timbre setting information is provided for setting a music tone parameter based on the timbre setting information. A first sound source is disposed on the mother board, and is operative based on the music tone parameter which is set by the control circuit for generating a first music tone when the performance information is inputted through the input terminal. A connector is provided on the mother board for optionally receiving an extension board having a second sound source for generating a second music tone. In this construction, the control circuit can operate in case that the extension board is inserted into the connector for providing the timbre setting information to the extension board through the connector for remotely setting the music tone parameter of the second sound source according to the timbre setting information so that the second sound source can generate the second music tone.

Preferably, the control circuit operates before providing the timbre setting information for providing identification information indicative of a type of the timbre setting information to the extension board through the connector so that the second sound source can recognize the timbre setting information. In the music apparatus, a display device displays the music tone parameter to be set according to the timbre setting information, and further displays an identification symbol indicative of whether or not the displayed music tone parameter is to be set to the second sound source.

Further, an inventive edit apparatus is constructed for editing a parameter necessary for generating a music tone while monitoring the parameter according to display information. In the edit apparatus, a display device is provided for displaying a current value of the parameter to be edited. An input device is operable for inputting an operational variable effective to change the current value of the parameter. A first control circuit is operative when receiving the display information for controlling the display device to update the current value of the parameter, and is operative when the operational variable is inputted from the input device for transmitting the operational variable. A second control circuit is provided for memorizing the current value of the parameter so as to generate the music tone, and is operative when the operational variable is transmitted from the first control circuit for updating the current value of the parameter and for transmitting the display formation indicative of the updated value of the parameter to the first control circuit so that the first control circuit can control the display device to display the updated value of the parameter.

Practically, the first control circuit is mounted in a main frame having the display device and the input device. The second control circuit is mounted on an extension board which is communicably connectable to the main frame so that the second control circuit can receive the operational variable from the first control circuit and can transmit the display information to the first control circuit.

Still further, an inventive music apparatus is constructed on a mother board, and is responsive to performance information for generating a music tone having a desired effect according to effect setting information. In the music apparatus, an input terminal is provided for inputting performance information. A control circuit is disposed on the mother board, and is operative when the effect setting information is provided for setting an effect parameter based on the effect setting information. A sound source is disposed on the mother board, and is operative when the performance information is inputted through the input terminal for generating a music tone. A connector is provided on the mother board for optionally receiving an extension board which can be set with the effect parameter for imparting the effect to the music tone generated by the sound source. In this construction, the control circuit can operate in case that the extension board is inserted into the connector for providing the effect setting information to the extension board through the connector for remotely setting the effect parameter of the extension board.

According to a second aspect of the invention, the music apparatus is responsive to performance information for generating a music tone having a selected timbre. In the music apparatus, a first sound source is responsive to the performance information for generating a first music tone having a timbre selected from a plurality of different timbres pre-installed in the first sound source. A second sound source is responsive to the performance information for generating a second music tone having a timbre selected from a plurality of different timbres pre-installed in the second sound source. An input device provides the performance information concurrently to both of the first sound source and the second sound source so as to generate the first music tone and the second music tone in parallel to each other. A control device is coupled to the first sound source, and is operative when the selected timbre of the first music tone is identical to the selected timbre of the second music tone for controlling the first sound source to inhibit generation of the first music tone while allowing the second sound source to generate the second music tone.

Preferably, the second sound source informs the control device of a timbre map indicating the timbres pre-installed in the second sound source so that the control device operates according to the timbre map for identifying a common timbre contained in both of the pre-installed timbres of the first sound source and the pre-installed timbres of the second sound source to thereby control the first sound source to inhibit generation of the first music tone when the common timbre is selected therefor. Preferably, the second sound source feeds the second music tone generated by the second sound source to the first sound source. The first sound source mixes the second music tone fed from the second sound source with the first music tone generated by the first sound source so as to acoustically output mixture of the first music tone and the second music tone. Practically, the first sound source is mounted on the mother board together with the input device and the control device. The second sound source is mounted on the extension board which is optionally connectable to the mother board.

Further, an inventive music apparatus is constructed on a mother board, and is responsive to a performance signal provided from an external source for generating a music tone. In the music apparatus, an input terminal is provided on the mother board for receiving the performance signal from the external source. An internal sound source is provided on the mother board, and is responsive to the performance signal for generating a music tone. An internal interface is provided on the mother board for passing the performance signal inputted from the input terminal to the internal sound source. An external interface is provided on the mother board for optionally receiving an extension board having an external sound source for generating a music tone in response to the performance signal inputted from the input terminal. A photo-coupler is interposed between the input terminal and both of the internal interface and the external interface for feeding the performance signal concurrently to both of the internal sound source and the external sound source without substantial delay of the performance signal to thereby enable concurrent generation of the music tones by both of the internal sound source and the external sound source.

According to a third aspect of the invention, the music apparatus is constructed on a mother board for synthesizing a music tone by means of audio modules assembled according to a synthesis algorithm. In the music apparatus, one or more of internal audio module is provided in the mother board. A connector is provided in the mother board for optionally receiving therein an extension board having one or more of external audio module. The extension board is operative when coupled to the mother board for notifying thereto identification information identifying the external audio module owned by the extension board. A setting device is provided in the mother board for assembling altogether one or more of the internal audio module and one or more of the external audio module identified by the identification information so as to set the synthesis algorithm by which the music tone is synthesized.

Preferably, the extension board notifies the identification information identifying the external audio module as either of a tone generator for generating a music tone and an acoustic effector for imparting an effect to a music tone. In other case, the extension board notifies the identification information identifying the external audio module as either of a simple module designed for treating a single part of the music tone and a complex module designed for treating multiple parts of the music tone. Practically, the setting device assembles altogether the internal and external audio modules including a tone generator for generating the music tone composed of a plurality of music parts, an insertion effector for imparting an effect to a selected one of the music parts, a mixer for mixing selected ones of the music parts to form a group, and a system effector for imparting an effect to the group.

BRIEF DESCRIPTION OF THE DRAWINGS

These and other objects of the invention will be seen by reference to the description, taken in connection with the accompanying drawings, in which.

DETAILED DESCRIPTION OF PREFERRED EMBODIMENTS

This invention will be described in further detail by way of example with reference to the accompanying drawings.

1. Overview of Preferred Embodiments

1.1 Editing Parameters Specific to a Plug-in Board

Figure 6:
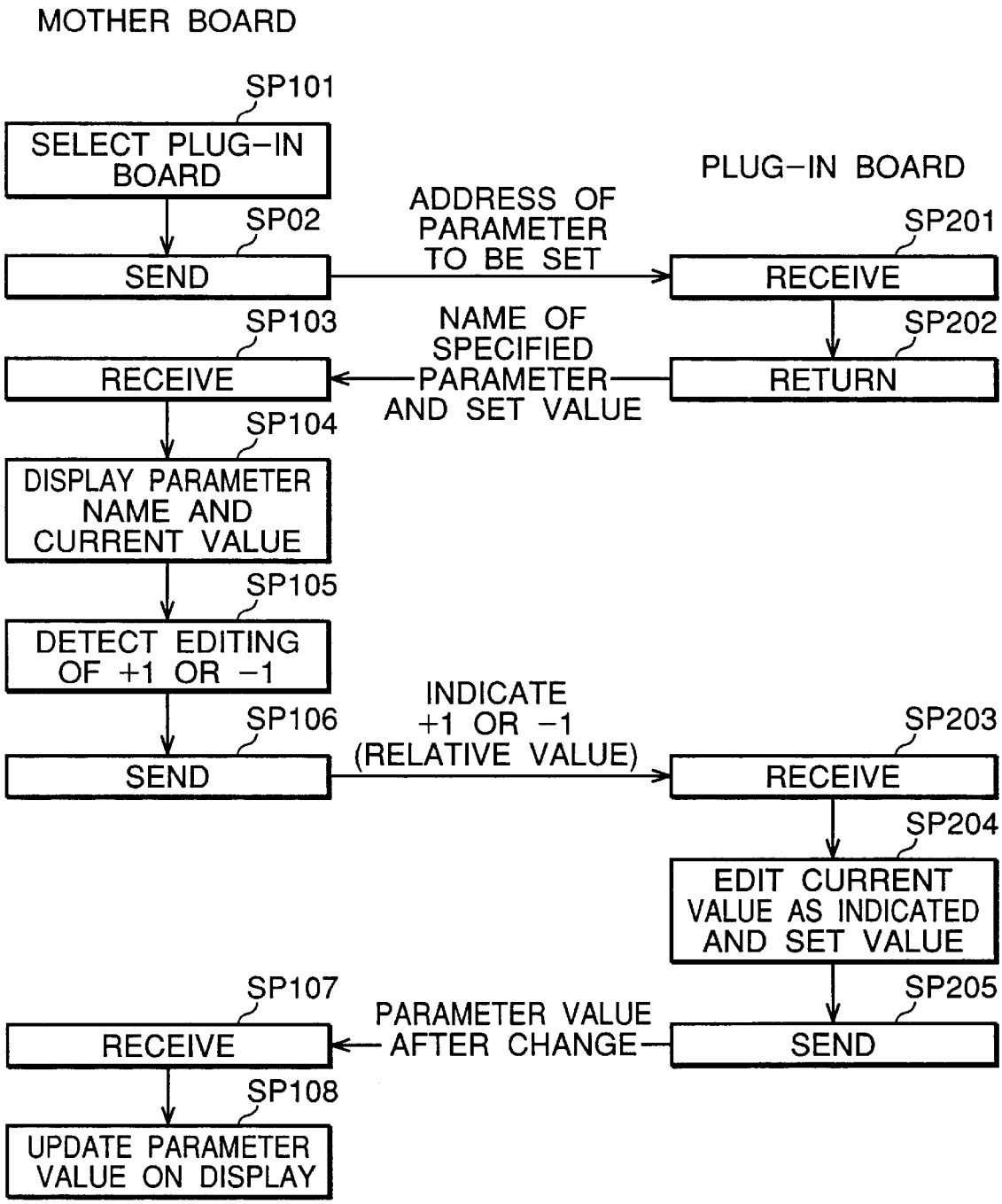
FIG. 6 is a flowchart indicative of a state of communication between a mother board and a plug-in board.
Figure 7:
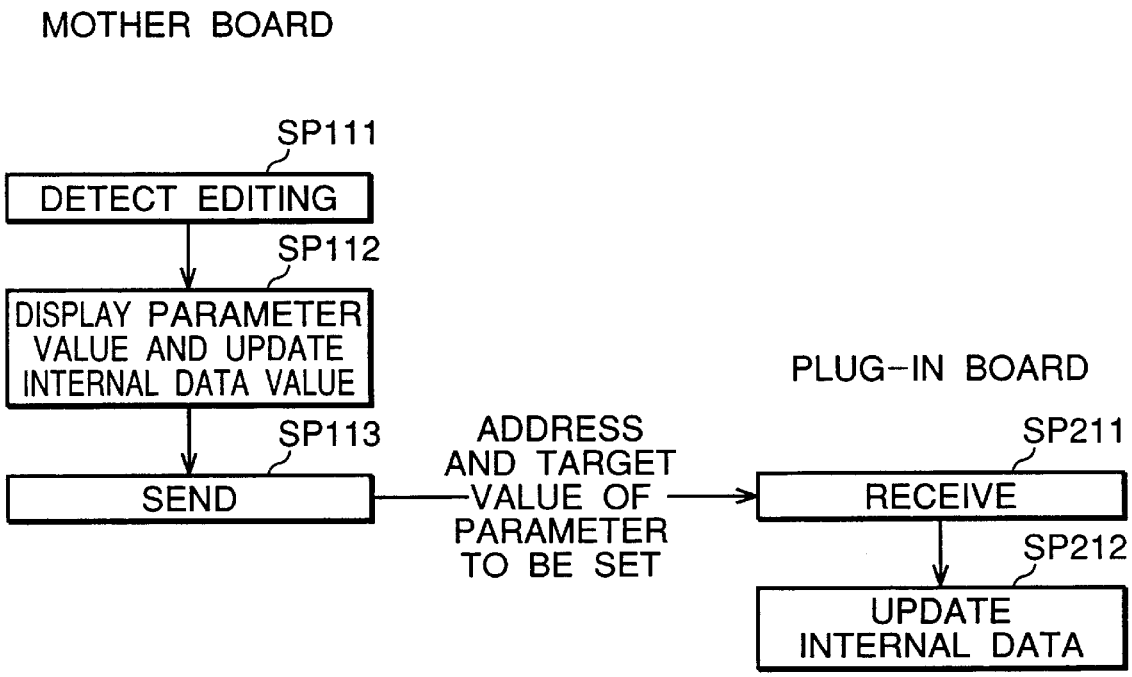
FIG. 7 is a flowchart indicative of another state of communication between the mother board and the plug-in board.
Figure 8:
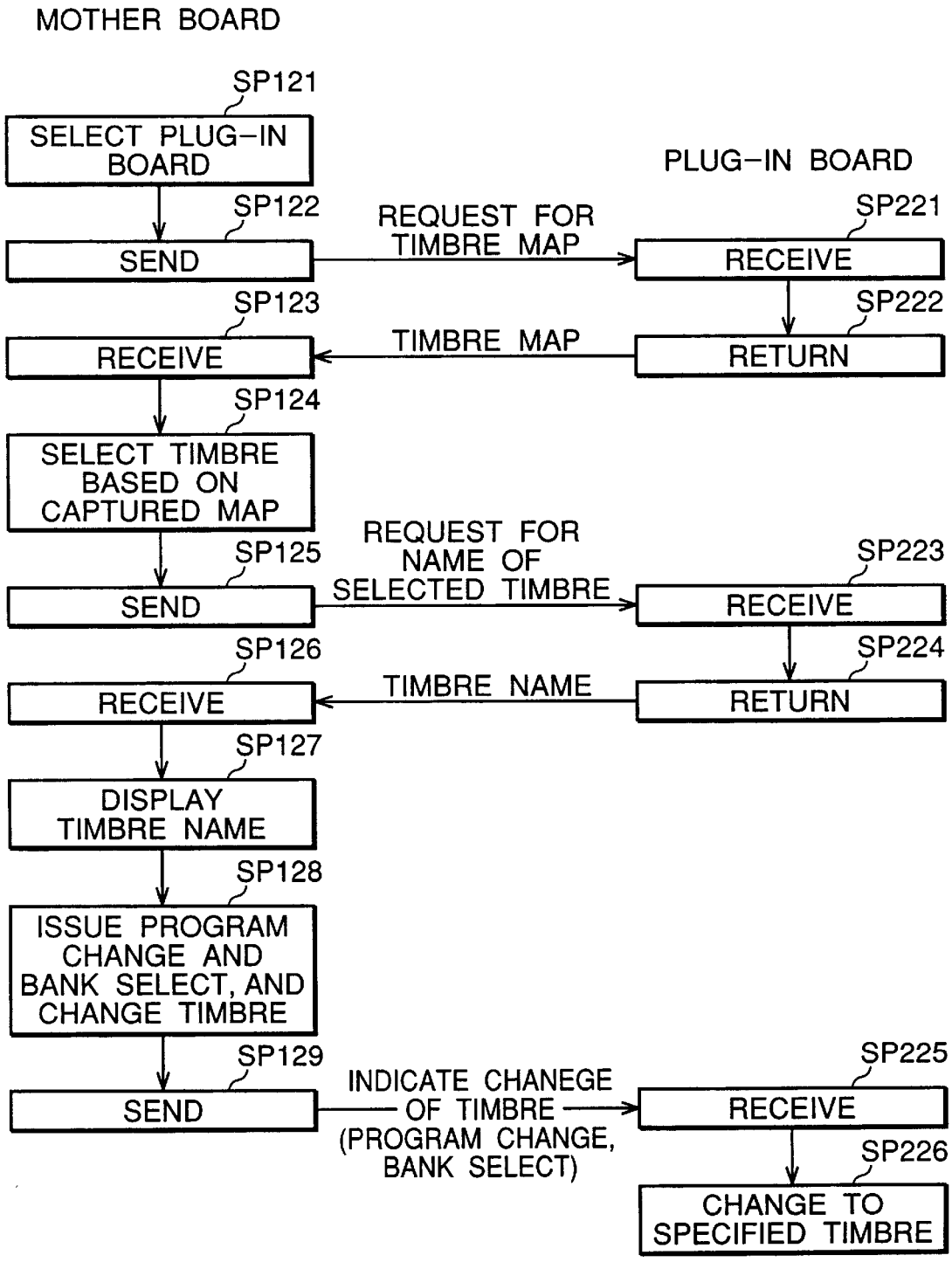
FIG. 8 is a flowchart indicative of still another state of communication between the mother board and the plug-in board.

Now, referring to FIGS. 6 through 8, an electronic musical instrument practiced as one preferred embodiment of the present invention will be outlined. It should be noted that "parameter" herein denotes a parameter for setting a particular timbre or acoustic effect, contents of the parameter being dependent on the type of a plug-in board installed. In the Figure, blocks on the left side indicate processing operations to be executed by a CPU installed on a mother board, while blocks on the right side indicate processing operations to be executed by another CPU installed on a plug-in board.

Referring to FIG. 6, in step SP101, a plug-in board to be processed is selected in the mother board. Namely, the present embodiment allows a plurality of plug-in boards to be selected. Therefore, it is required to specify a particular plug-in board to be communicated with the mother board. In this step, one plug-in board is selected by a panel switch operation performed by the user. Next, in step SP102, address information and a model ID for identifying a parameter to be set are transmitted from the mother board to the specified plug-in board. This plug-in board receives these address information and model ID in step SP201, and transmits the current value of the identified parameter to the mother board in step SP202.

When the current value is received by the mother board (step SP103), the name of the parameter and the current value are displayed on a display device provided in a main frame of the electronic musical instrument. Then, the user specifies increment or decrement of the parameter. To be more specific, the user reads the displayed value, and operates an increment/decrement key on an operator panel of the electronic musical instrument. This operation is detected in step SP105. When the value input made by the user is detected, a command of increment or decrement is transmitted from the mother board to the plug-in board (step SP106).

When this command is received by the plug-in board in step SP203, the current value is updated in the plug-in board by step SP204 according to the received command. In this update operation, limit processing is executed on the parameter value as required. The results of this processing need only be recognized by the plug-in board.

When the current value has been updated, then in step SP205, the update result is transmitted to the mother board. The update result is received by the mother board in step SP107 and displayed to the user in step SP108. In the processing flow so far described, any parameter specific to the plug-in board can be displayed on the display device of the electronic musical instrument, and can be edited by operating switches on the operator panel.

1.2 Editing Parameters Shared by the Plug-in Board and the Mother Board

The following outlines editing of parameters shared by the plug-in board and the mother board with reference to FIG. 7. First, in step SP111, an edit command issued by the user is detected by the mother board. The edit command is issued when the user operates an edit-associated switch on the operator panel. Then, in step SP112, the value of the parameter common to the plug-in board and the mother board is updated according to the command, and the result is displayed.

In step SP113, the address information, model ID, and set value of the updated parameter are transmitted to the plug-in board. The plug-in board receives the address information, model ID and the set value in step SP211. Based on these pieces of information, an old set value stored in the plug-in board is updated (step SP212). Thus, according to this processing flow, the parameters shared by the mother board and the plug-in board can be edited by operating the edit-associated switch on the electronic musical instrument.

1.3 Selecting Timbres of the Plug-in Board

The following outlines processing of selecting a timbre of the plug-in board having a sound source with reference to FIG. 8. Referring to FIG. 8, in step SP121, a sound source plug-in board is selected by the mother board. Then, in step SP122, a request for a timbre map indicative of timbres supported by the sound source of the plug-in board is transmitted from the mother board to the plug-in board.

In step SP221, the plug-in board receives the request. In step SP222, the timbre map is transmitted to the mother board. In step SP123, the mother board receives the timbre map. In step SP124, the mother board specifies a timbre to be used. Namely, the mother board detects a switch operation made by the user on the operator panel. Then, according to the detection, the mother board specifies a timbre to be used among plural timbres contained in the timbre map. Then, in step SP125, the mother board transmits a request for the timbre name of the selected timbre to the plug-in board.

In step SP223, the plug-in board receives the request. In step SP224, the plug-in board transmits ASCII data indicative of the timbre name to the mother board. On the other hand, in step SP126, the mother board receives the ASCII data. In step SP127, the mother board displays the ASCII data on the display device. At this moment, an identifier symbol or icon is also displayed so that the timbre provided by the plug-in board can be recognized.

If it is necessary to switch between timbres, the mother board issues a program change signal and a bank select signal in step SP128. In step SP129, these signals are transmitted to the plug-in board. In step SP225, the plug-in board receives these signals. In step SP226, switching to the specified timbre is made.

In the above-mentioned processing flow, any of the timbres of the plug-in board can be efficiently selected by operating the selector switch on the operator panel of the electronic musical instrument, and the name of the selected timbre can be displayed on the display device of the electronic musical instrument. Because the switching between timbres is executed by the program change and bank select signals, the selection can be made in the same manner as an externally inputted MIDI signal is selected. This ensures integrity between the selection from the operator panel and the selection from the external source.

The above-mentioned procedure is not to be construed to limit timbre selection. Rather, it is widely applicable to making selection in music data such as effect data, waveform data, rhythm data, and automatic performance data.

2. Hardware Constitution of Preferred Embodiment

2.1 Overall Constitution

Figure 1:
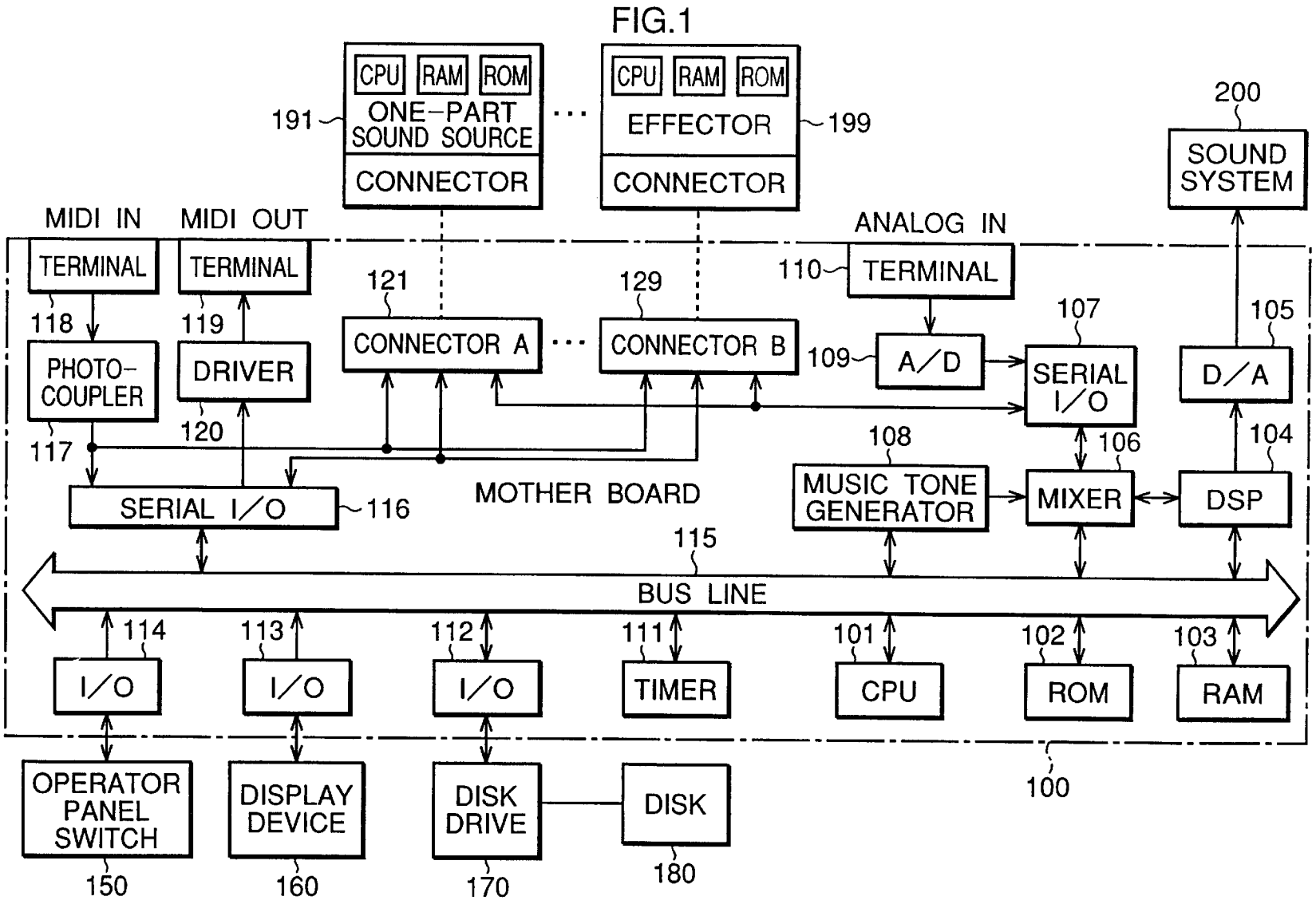
FIG. 1 is a block diagram illustrating a hardware constitution of an electronic musical instrument practiced as one preferred embodiment of the invention.

The following describes a constitution of the electronic musical instrument of the present embodiment with reference to FIG. 1. In the Figure, reference numeral 100 denotes a mother board. Reference numerals 191 through 199 denote plug-in boards or extension boards attachable to and detachable from the mother board 100. A CPU 101 of the mother board 100 controls other components of the mother board 100 based on a control program stored in a ROM 102. Reference numeral 103 denotes a RAM, which is used as a work memory of the CPU 101 and a data memory. Each of the plug-in boards 191 through 199 has a CPU, a RAM, and a ROM. This CPU operates independently of the CPU 101 of the mother board, exchanging various pieces of data with the mother board.

Reference numeral 108 denotes a music tone generator for generating a tone signal based on performance information supplied from the CPU 101. Reference numeral 104 demotes a DSP (Digital Signal Processor) for executing processing such as filtering on tone signals of plural channels. Reference numeral 110 denotes an analog input terminal, from which an analog audio signal is inputted to be converted by an A/D converter 109 into a digital audio signal. Reference numerals 121 through 129 denote connectors or external interfaces adapted to mate with connectors of the plug-in boards 191 through 199.

Reference numeral 107 denotes a serial I/O port for converting a supplied parallel signal to a serial signal and for feeding the same to the connectors 121 through 129. Otherwise, the serial I/O port 107 converts a serial signal received through the AID converter 109 into a parallel signal. Reference numeral 106 denotes a mixer for mixing various supplied tone signals. It should be noted that this mixer 106 executes mixing at a different mixing ratio for each output destination by a time-division multi-channel operation.

The tone signals to be mixed include the tone signal generated by the music tone generator 108, the tone signal generated by the DSP 104, and the tone signal supplied through the serial I/O port 107. The result of this mixing is supplied to the serial I/O port 107 or the DSP 104. The DSP 104 is capable of processing the tone signals of plural channels, two of which are output channels. Namely, the tone signals supplied to these output channels are filtered, and the filtered signals are converted by a D/A converter 105 into analog signals to be sounded through a sound system 200.

Reference numeral 111 denotes a timer for causing a timer interrupt to the CPU 101. Reference numeral 170 is a disk drive for recording data supplied through a bus 115 and an I/O port 112 onto a disk 180, and for reading data from the disk 180 to the CPU 101, the RAM 103 and so on through the I/O port 112 and the bus 115. The disk 180 may be used as a machine readable medium containing program instructions executable by the CPU 101. Reference numeral 160 is a panel display device for displaying the data supplied through an I/O port 113. Reference numeral 150 denotes a panel switch provided with various operator keys. For example, these operator keys include numeric keys 0 through 9, an enter key for establishing an inputted value, cursor keys for moving a cursor in desired directions, scroll keys for scrolling a screen displayed on the panel display device 160, an increment/decrement key for incrementing or decrementing various parameters. An operation event and a volume of operation of these operator keys are sent to the CPU 101 through an I/O port 114 and the bus 115.

Reference numeral 118 denotes a MIDI input terminal or input port that receives a MIDI signal from an external MIDI equipment including a sequencer and a keyboard. Reference numeral 117 denotes a photo-coupler for electrically separating the MIDI input terminal 118 from the circuitry on the mother board 100. An input MIDI signal outputted from the photo-coupler 117 is supplied to the CPU 101 through a serial I/O port 116 or an internal interface and also to the plug-in boards 191 through 199 through the connectors 121 and 129 or external interfaces. Namely, the same MIDI signal is supplied to the mother board 100 and the plug-in boards 191 through 199 with the same timing.

This is one of the features of the present invention. To be more specific, in the present embodiment, a MIDI signal is supplied to the plug-in boards 191 through 199 without passing it through the CPU 101, thereby preventing the supply of the MIDI signal from being delayed. In other words, the inputted MIDI signal is supplied to both the mother board 100 and the plug-in boards 191 through 199, and preset operations are executed by the CPU of the mother board and by the CPU of the plug-in boards separately. For example, if a timbre supported by the plug-in board 191 is selected, the plug-in board 191 executes a tone synthesizing operation by its own decision, and the mother board 100 inhibits tone synthesis by its own decision.

Reference numeral 120 denotes a driver for amplifying a MIDI signal supplied from the CPU 101 through the bus 115 and the serial I/O port 116, and for outputting the amplified MIDI signal. If it is necessary to externally output a MIDI signal generated by the plug-in boards 191 through 199 outside, this MIDI signal is supplied to the CPU 101 through the serial I/O port 116. The CPU 101 merges the MIDI signal generated by the mother board 100 with the MIDI signal generated by the plug-in boards 191 through 199 after timing adjustment, the merged MIDI signal being outputted through the serial I/O port 116 and the driver 120.

2.2 Channel Constitution

Figure 2:
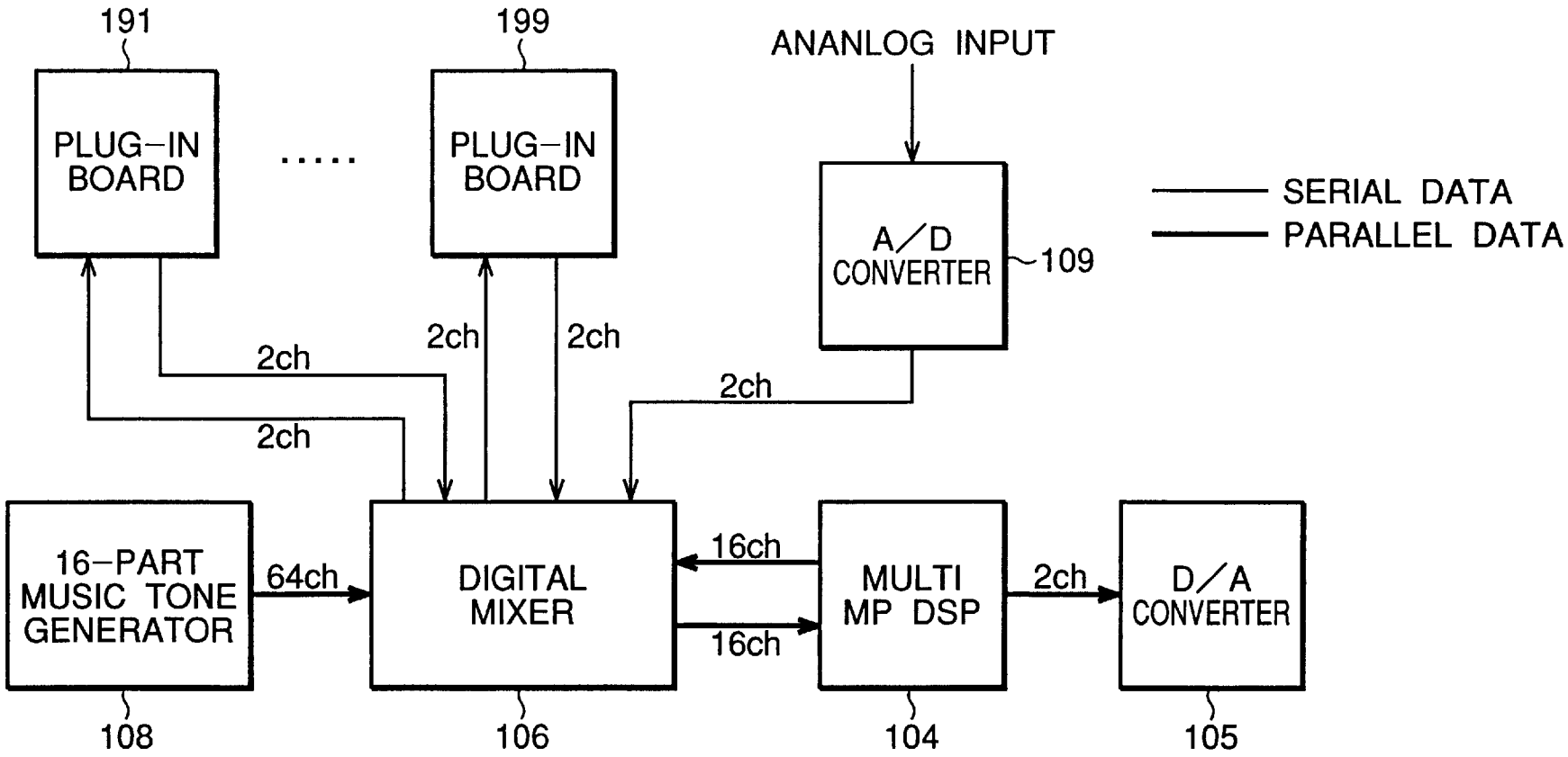
FIG. 2 is a block diagram illustrating a channel constitution of the above-mentioned preferred embodiment.

The following describes a channel constitution in the present embodiment with reference to FIG. 2.

The above-mentioned music tone generator 108 generates tone signals of 16 parts (one part being equivalent to one MIDI channel) equivalent to 64 sounding channels. The mixer 106 is a digital mixer having many input channels and output channels. The mixer 106 assigns two input channels and two output channels to each of the plug-in boards 191 through 199, and assigns two input channels to the A/D converter 109.

Further, the mixer 106 assigns 16 input channels and 16 output channels to the DSP 104. Of these 16 output channels, two channels are output channels to the outside. Tone signals associated with these output channels are filtered through the DSP 104 to be supplied to the D/A converter 105.

2.3 Flow of Tone Signal

Figure 3:
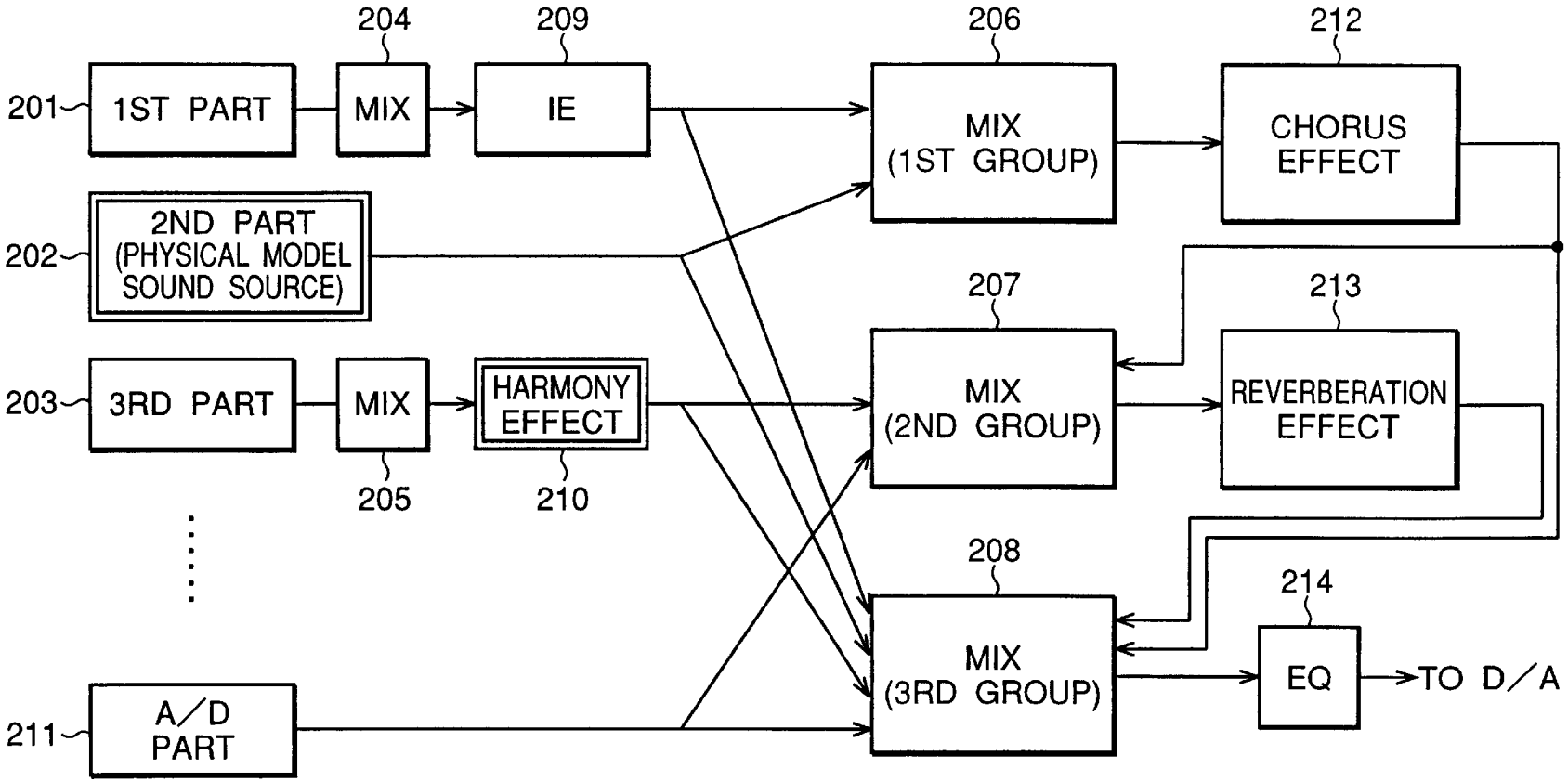
FIG. 3 is a block diagram illustrating an example of a tone generating algorithm set in the above-mentioned preferred embodiment.

Flow of tone signals among the mixer 106, the DSP 104, the music tone generator 108, the plug-in boards 191 through 199, and the A/D converter 109 is determined by a setting state of the mixer 106 and a microprogram to be executed by the DSP 104. This flow is represented as a signal flow shown in FIG. 3. Referring to FIG. 3, reference numerals 201 and 203 denote a first part and a third part in the music tone generator 108.

A second part 202 is implemented by a plug-in board that provides a physical model sound source. Reference numeral 211 denotes an A/D part, which is implemented by the A/D converter 109.

Reference numeral 209 denotes an insertion effector for imparting various effects to a tone signal of the first part. An insertion effect herein denotes an effect to be applied to one part of the music tone signals. Reference numeral 210 denotes a harmony part generating block, one type of insertion effector, which is implemented by a plug-in board (a harmony part generating board for example). The harmony part generator generates a harmony effect by adding to an input waveform or waveform data a harmony tone in a predetermined musical interval relationship with the input waveform or waveform data.

Reference numerals 204 through 208 denote mixing blocks, which are implemented by the mixer 106. Reference numeral 212 denotes a chorus effect block for imparting a chorus effect to the mixing results of the mixing block 206. Reference numeral 213 denotes a reverberation effect block for imparting a reverberation effect to these mixed results. The mixed result of the mixing block 208 is supplied to a channel to the outside. This result is equalized by an equalizer 214 to be supplied to the D/A converter 105.

The insertion effector 209, the chorus effect block 212, the reverberation effect block 213, and the equalizer 214 are implemented by the time-division processing by the DSP 104. The chorus effect block 212, the reverberation effect block 213, and the equalizer 214 impart respective effects to the result of mixed tone signals of plural parts. These are referred to as system effects. The mixing blocks 206 through 208 in which plural parts can be inputted are referred to as a group.

Figure 4:
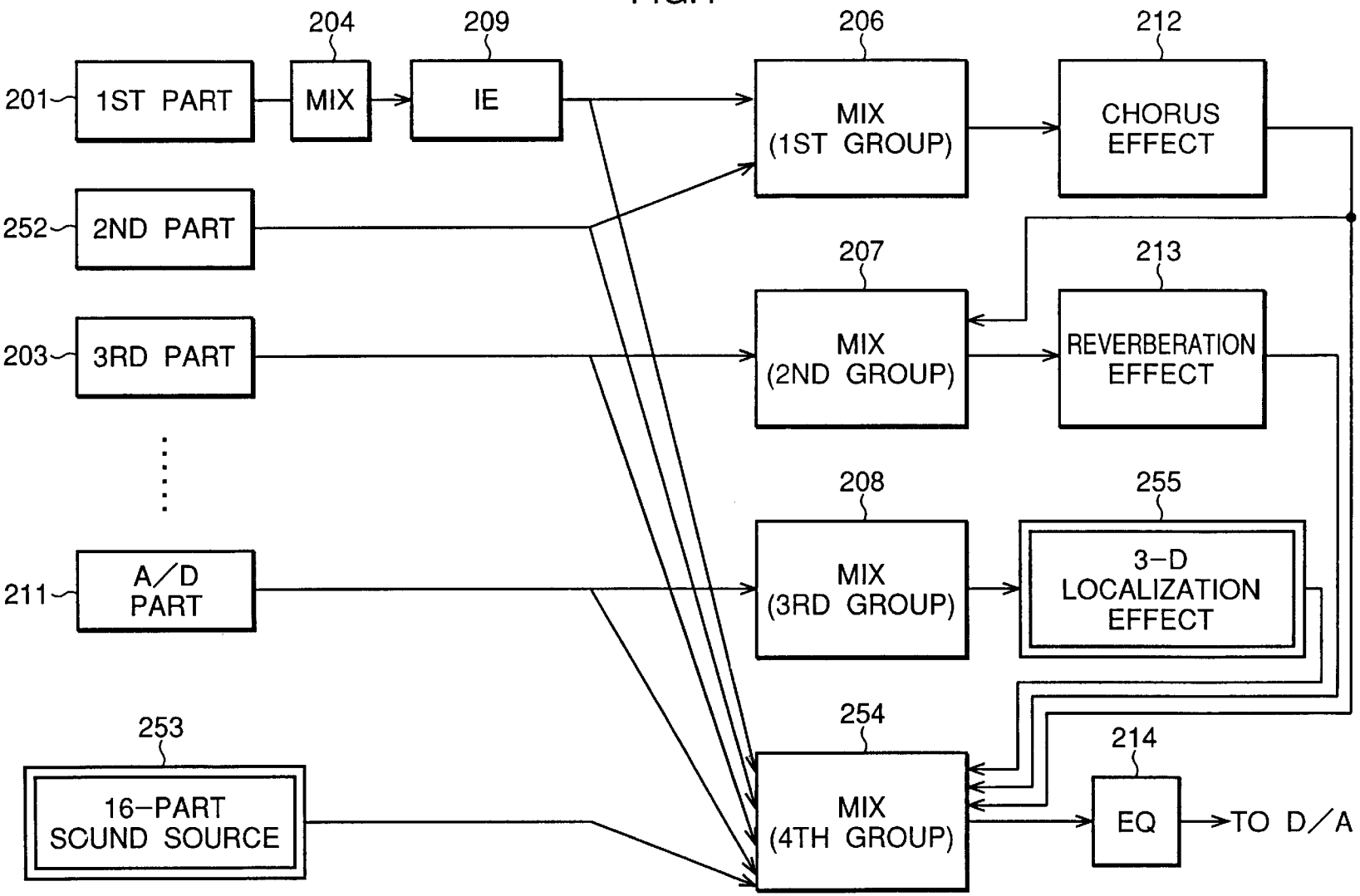
FIG. 4 is a block diagram illustrating another example of a tone generating algorithm set in the above-mentioned preferred embodiment.

The following describes another signal flow with reference to FIG. 4. In the Figure, reference numeral 252 denotes a second part of the music tone generator 108, and reference numeral 253 denotes a 16-part sound source provided independently of the music tone generator 108. Reference numeral 255 denotes a three-dimensional localization effect block for performing a three-dimensional localization effect on the result from the mixing block 208.

Reference numeral 254 denotes a mixing block for mixing the tone signals of the first part 201 through the A/D part 211, 16-part sound source 253, and the three-dimensional localization effect block 255. The mixing block 254 is implemented by the mixer 106, and the 16-part sound source 253 and the three-dimensional localization effect block are implemented by the plug-in boards.

2.4 Types of Plug-in Boards

The plug-in boards 191 through 199 are classified into the following four types.

(1) Single-part Sound Source

In a single-part sound source plug-in board, the sound source is constituted by a single part as with the above-mentioned second part 202. In MIDI, performance data based on 16 MIDI channels can be transmitted. The single-part sound source responds to the performance of one MIDI channel to generate a music tone. The tone signal outputted from the single-part sound source is handled in the same manner as each part of the music tone generator 108, and can be applied with various effects in the DSP 104.

(2) Multi-part Sound Source

A multi-part sound source plug-in board has plural parts like the above-mentioned 16-part sound source 253, and outputs the tone signals of these parts in a mixed form. Of the above-mentioned 16 MIDI channels, The multi-part sound source operates according to inputs of plural MIDI channels to generate music tones of the corresponding plural parts. A so-called GM (General MIDI) sound source is one of the multi-part sound sources.

(3) Insertion Effect

An insertion effect of a plug-in board is applied to one part of a tone signal as described above. The plug-in board implementing the harmony part generating block 210 provides this effect.

(4) System Effect

A system effect plug-in board imparts effects to the mixed result of the tone signals of plural parts as described above. The plug-in board for implementing the three-dimensional localization effect block 255 provides such a system effect. In addition, there is a system effect plug-in board for imparting a general effect such as reverberation.

Referring back to FIG. 1, according to the first aspect of the invention, the music apparatus is constructed on the mother board, and is responsive to performance information or MIDI signal for generating a music tone having a desired timbre according to timbre setting information. In the music apparatus, the input terminal 118 is provided for inputting performance information. A control circuit composed of the CPU 101 is disposed on the mother board 100, and is operative when the timbre setting information is provided from the panel switch 15 for setting a music tone parameter based on the timbre setting information. A first sound source containing the tone generator 108 is disposed on the mother board 100, and is operative based on the music tone parameter which is set by the control circuit for generating a first music tone when the performance information is inputted through the input terminal 118. The connector 121 is provided on the mother board 100 for optionally receiving the extension board 191 having a second sound source for generating a second music tone. In this construction, the control circuit can operate in case that the extension board 191 is inserted into the connector 121 for providing the timbre setting information to the extension board 191 through the connector 121 for remotely setting the music tone parameter of the second sound source according to the timbre setting information so that the second sound source can generate the second music tone.

Preferably, the control circuit operates before providing the timbre setting information for providing identification information indicative of a type of the timbre setting information to the extension board 191 through the connector 121 so that the second sound source can recognize the timbre setting information. In the music apparatus, the display device 160 displays the music tone parameter to be set according to the timbre setting information, and further displays an identification symbol indicative of whether or not the displayed music tone parameter is to be set to the second sound source.

Further, the edit apparatus is constructed on the mother board 100 for editing a parameter necessary for generating a music tone while monitoring the parameter according to display information. In the edit apparatus, the display device 160 is provided for displaying a current value of the parameter to be edited. An input device including the panel switch 150 is operable for inputting an operational variable effective to change the current value of the parameter. A first control circuit contained in the CPU 101 is operative when receiving the display information for controlling the display device 160 to update the current value of the parameter, and is operative when the operational variable is inputted from the input device for transmitting the operational variable. A second control circuit composed of a CPU and a RAM is provided in the extension board 191 for memorizing the current value of the parameter so as to generate the music tone, and is operative when the operational variable is transmitted from the first control circuit for updating the current value of the parameter and for transmitting the display formation indicative of the updated value of the parameter to the first control circuit so that the first control circuit can control the display device 160 to display the updated value of the parameter.

Practically, the first control circuit is mounted in the mother board 100 of a main frame having the display device 160 and the input device 150. The second control circuit is mounted on the extension board 191 which is communicably connectable to the main frame so that the second control circuit can receive the operational variable from the first control circuit and can transmit the display information to the first control circuit.

Moreover, the music apparatus is constructed on the mother board 100, and is responsive to performance information for generating a music tone having a desired effect according to effect setting information. In the music apparatus, the input terminal 118 is provided for inputting performance information. A control circuit composed of the CPU 101 is disposed on the mother board 100, and is operative when the effect setting information is provided from the panel switch 150 for setting an effect parameter based on the effect setting information. A sound source containing the tone generator 108 is disposed on the mother board 100, and is operative when the performance information is inputted through the input terminal 118 for generating a music tone. The connector 129 is provided on the mother board 100 for optionally receiving the extension board 199 which can be set with the effect parameter for imparting the effect to the music tone generated by the sound source. In this construction, the control circuit can operate in case that the extension board 199 is inserted into the connector 129 for providing the effect setting information to the extension board 199 through the connector 129 for remotely setting the effect parameter of the extension board 199.

According to the second aspect of the invention, the music apparatus is responsive to performance information for generating a music tone having a selected timbre. In the music apparatus, a first sound source composed of the tone generator 108 is responsive to the performance information for generating a first music tone having a timbre selected from a plurality of different timbres pre-installed in the first sound source. A second sound source provided as the extension board 191 is responsive to the performance information for generating a second music tone having a timbre selected from a plurality of different timbres pre-installed in the second sound source. An input device including the input terminal 118 provides the performance information concurrently to both of the first sound source and the second sound source so as to generate the first music tone and the second music tone in parallel to each other. A control device composed of the CPU 101 is coupled to the first sound source, and is operative when the selected timbre of the first music tone is identical to the selected timbre of the second music tone for controlling the first sound source to inhibit generation of the first music tone while allowing the second sound source to generate the second music tone.

Preferably, the second sound source informs the control device of a timbre map indicating the timbres pre-installed in the second sound source so that the control device operates according to the timbre map for identifying a common timbre contained in both of the pre-installed timbres of the first sound source and the pre-installed timbres of the second sound source to thereby control the first sound source to inhibit generation of the first music tone when the common timbre is selected therefor. Preferably, the second sound source feeds the second music tone generated by the second sound source to the first sound source. The first sound source mixes the second music tone fed from the second sound source with the first music tone generated by the first sound source so as to acoustically output mixture of the first music tone and the second music tone. Practically, the first sound source is mounted on the mother board 100 together with the input device and the control device. The second sound source is mounted on the extension board 191 which is optionally connectable to the mother board 100.

Further, the music apparatus is constructed on the mother board 100, and is responsive to a performance signal provided from an external source for generating a music tone. In the music apparatus, the input terminal 118 is provided on the mother board 100 for receiving the performance signal or MIDI signal from the external source. An internal sound source containing the tone generator 108 is provided on the mother board 100, and is responsive to the performance signal for generating a music tone. The internal interface 116 is provided on the mother board 100 for passing the performance signal inputted from the input terminal 118 to the internal sound source. An external interface is provided on the mother board 100 in the form of the connector 121 for optionally receiving the extension board 191 having an external sound source for generating a music tone in response to the performance signal inputted from the input terminal 118. A photo-coupler 117 is interposed between the input terminal 118 and both of the internal interface 116 and the external interface 121 for feeding the performance signal concurrently to both of the internal sound source and the external sound source without substantial delay of the performance signal to thereby enable concurrent generation of the music tones by both of the internal sound source and the external sound source.

According to the third aspect of the invention, the music apparatus is constructed on the mother board 100 for synthesizing a music tone by means of audio modules assembled according to a synthesis algorithm. In the music apparatus, one or more of internal audio module composed of the tone generator 108, the mixer 106 and the DSP 104 is provided in the mother board 100. The connector 121 or 129 is provided in the mother board 100 for optionally receiving therein the extension board 191 or 199 having one or more of external audio module. The extension board 191 or 199 is operative when coupled to the mother board 100 for notifying thereto identification information identifying the external audio module owned by the extension board 191 or 199. A setting device composed of the panel switch 150, the panel display device 160 and the CPU 101 is provided in the mother board 100 for assembling altogether one or more of the internal audio module and one or more of the external audio module identified by the identification information so as to set the synthesis algorithm by which the music tone is synthesized.

Preferably, the extension board 191 or 199 notifies the identification information identifying the external audio module as either of a tone generator 253 for generating a music tone and an acoustic effector 255 for imparting an effect to a music tone. In other case, the extension board notifies the identification information identifying the external audio module as either of a simple module 202 designed for treating a single part of the music tone and a complex module 253 designed for treating multiple parts of the music tone. Practically, the setting device assembles altogether the internal and external audio modules including a tone generator 108 for generating the music tone composed of a plurality of music parts, an insertion effector 209 or 210 for imparting an effect to a selected one of the music parts, a mixer 206, 207 or 208 for mixing selected ones of the music parts to form a group, and a system effector 212 or 213 for imparting an effect to the group.

3. Protocol of Preferred Embodiment

3.1 Timbre Mapping

The present preferred embodiment uses timbre mapping based on XG standard. In XG standard, a timbre is represented by an 8-byte bank select MSB, another 8-byte bank select LSB, and an 8-byte program change.

In the bank select MSB, "0" is assigned to melody timbre, "64" is assigned to SFX timbre, "126" is assigned to SFX kit, and "127" is assigned to drum voice (the remaining values are currently inhibited for use). The program change at the bank select LSB="0" in the melody timbre is compatible with the program change of GM standard, and is assigned with 128 types of basic timbres "Acoustic Grand Piano," "Bright Acoustic Piano," . . . , "Bang."

Variations of these basic timbres are mapped by the bank select LSB. Namely, if the bank select LSB is 0, the basic timbres are provided; if the bank select LSB is 1 to 127, variations of the basic timbres are provided. In XG standard, a maximum of 4×128×128=65,536 types of timbres can be mapped.

3.2 General Method of Timbre Selection

The following describes a general method of selecting timbres based on the bank select LSB and the program change in XG standard. The following description assumes an example in which mapping is made with the program change being "17" (draw-bar organ), the bank select LSB being "0" (basic timbre), "1" and "2" (variations).

If only the program change "17" is specified without specifying the bank select LSB, "0" (basic timbre) is selected for ensuring compatibility with GM standard. If "0", "1" or "2" is specified for the bank select LSB, the timbre corresponding to the bank select LSB is selected without question. If an unmapped bank select LSB (for example, "3") is specified, "0" (basic timbre) is selected.

Another case is that basic timbre "0" is not mapped and only variations "1" and "2" are specified. In such a case, if the bank select LSB of "1" or "2" is specified, the corresponding variation timbre is selected. However, if only the program change is specified, or if a bank select LSB other than "1" or "2" is specified, one of variations "1" and "2" is selected.

3.3 Communication Modes

Between the plug-in boards 191 through 199 and the mother board 100, a tone signal (waveform data) and a control signal are transferred. The tone signal is transmitted through the serial I/O port 107 while the control signal is transmitted through the serial I/O 116. The control signal has the same format as that of a MIDI signal.

Namely, MIDI system exclusive is used for inquiries and setting from the CPU 101 of the mother board 100 to the plug-in boards 191 through 199 and for reply from the plug-in boards to the CPU 101. In doing so, the following two communication modes are used.

(1) Mode 1

In mode 1, two-way communication is made between the mother board 100 and the specified one of the plug-in boards. For example, mode 1 is used for inquiring the plug-in board as to a timbre editing state and for replying the query.

(2) Mode 2

In mode 2, the mother board 100 makes one-way communication to all the plug-in boards. Mode 2 is used for one-way data transmission for initializing and timbre editing operations.

3.4 Details of Communication (1) Signal Format

The mother board and plug-in boards transfer information by exchanging messages. When one party transmits a message, a model ID indicative of the type of the message and an address indicative of a parameter associated with the message are transmitted to the other party of communication beforehand.

(1-1) Model ID

There are three types of model IDs, 4C, 4E, and 4F. 4C is used for communication between a mother board and plug-in boards, and indicates that it is controllable by an external MIDI signal. 4E is used for communication between a mother board and plug-in boards. 4F indicates a special command for use in communication between a mother board and plug-in boards. The special command has, before the model ID, a special command identifier indicative of special command type (first or second special command group) and a direction identifier indicative of request or reply. The request may have an argument. The data length of the reply is variable.

(1-2) Address

For example, in order to prevent a plug-in board from reception of a MIDI signal, the mother board must transmit message "MidiReceiveEnable/Disable" (details to be described later) to the plug-in board. In this case, the mother board sends the address (for example, 0x001002) of the message "MidiReceiveEnable/Disable" to the plug-in board, and then specifies "0" for the value of this message. In what follows, major messages to be used in the present embodiment will be described.

(2) Ordinary Commands

"General MIDI System Level 1" (so-called GM standard) and XG standard are known as the standards for controlling a sound source. The mother board and the plug-in boards used in the present preferred embodiment can exchange all commands specified by GM and XG standards, by which the mother board can edit various parameters to be used on the plug-in boards. The commands specified by GM and XG standards are manifold. In what follows, the frequently used parameter change will be described.

The model ID of an ordinary command is 4C. The address of a parameter to be changed is set in 3 bytes. The message of the parameter change is generally 1 byte long. This 1-byte message is used for on/off switching, data setting in range of −64 to +63, or data setting in range of 0 to 127, for example.

(3) System Setup

The following messages are transferred between the mother board and the plug-in board mainly in a system setup sequence (namely, a power-on sequence), of which model ID is 4E.

(3-1) DeviceNo

DeviceNo is a 1-byte message for the mother board to set a device number (1 to 16) to a plug-in board.

(3-2) ForceDump

ForceDump is a message for the mother board to instruct a plug-in board to perform force dump. If the value of this message is 00 to 1F, this message is regarded as specifying a part number to be force-dumped; if the value is 7F, it is regarded that all parts are force-dumped.

(3-3) MidiReceiveEnable/Disable

MidiReceiveEnable/Disable is a message for the mother board to specify a plug-in board to be enabled or disabled for receiving a MIDI signal. If the value of this message is "1", it indicates that the plug-in board is enabled for reception; if the value is "0", it indicates that the plug-in board is disabled for reception.

(3-4) SinglePartTgParameterBaseAddress

SinglePartTgParameterBaseAddress is a message for the mother board to specify a base address of a plug-in board if the plug-in board is a single-part sound source. Based on the specified base address, the plug-in board determines an address for altering various parameters.

(3-5) InsertionEffectParameterBaseAddress and SystemEffectParameterBaseAddress

InsertionEffectParameterBaseAddress is a message for specifying a base address of a plug-in board if the same is the insertion effector. Likewise, SystemEffectParameterBaseAddress is a message for specifying a base address of a plug-in board if the same is the system effector.

(3-6) SameTypePbTotalNo and SameTypePbSerialNo

If there are plural plug-in boards of the same type, SameTypePbTotalNo and SameTypePbSerialNo are messages to be transmitted from the mother board to these plug-in boards. SameTypePbTotalNo informs a total number of plug-in boards of the same type. SameTypePbSerialNo informs each of these plug-in boards of its assigned serial number.

(3-7) MotherDisplayLevel

MotherDisplayLevel is a message for informing each plug-in board of the number of display characters to be used by the main frame of the electronic musical instrument.

(4) PB System Information

The following messages are transmitted from plug-in boards to the mother board mainly in a system setup sequence (namely a power-on sequence), of which model ID is 4E.

(4-1) PbName

PbName is used by each plug-in board to inform the mother board of a type name (for example, VH10-prg) of each plug-in board in an ASCII code of up to 14 bytes (28 characters).

(4-2) PbIconData

PbIconData is a message having a data length of 30H (=48) bytes and is used by each plug-in board to inform the mother board of bit map data of icon.

(4-3) PbType

PbType is a message having 3-byte data and is used by each plug-in board to inform the mother board of the type of the plug-in board. These 3 bytes are called PbTypeMsb, PbTypeLsb, and VersionNo. PbTypeMsb takes a value 0 to 3; 0 indicates single-part sound source, 1 indicates multi-part sound source, 2 indicates insertion effector, and 3 indicates system effector. PbTypeLsb indicates minor classification of each type. For example, if a plug-in board is single-part sound source, PbTypeLsb indicates a sound source scheme (physical model sound source, PCM sound source, or FM sound source). VersionNo represents a version number of the plug-in board.

(4-4) TotalNativeSystemParameterNo

NotalTativeSystemParameterNo is used by a plug-in board to inform the CPU 101 of a number of system parameters to be edited by a general-purpose parameter editor (a program) stored in the ROM 102 of the mother board 100. It should be noted that the system parameter denotes a parameter for use in mode setting of the plug-in board or else.

(4-5) TotalNativePartParameterNo

TotalNativePartParameterNo is a message for informing the mother board of a number of part parameters to be outputted from the plug-in board. It should be noted that the part parameter denotes a parameter to be set for each part of the plug-in board.

(4-6) TotalNativeEffectParameterNo

TotalNativeEffectParameterNo is a message for informing the mother board of a number of selectable effect parameters if the plug-in board is an effector.

(4-7) TotalVoiceMapNo

TotalVoiceMapNo is a message for informing the mother board of a number of selectable timbre maps if the plug-in board is a sound source. One map represents contents of the program change corresponding to one bank select MSB and one bank select LSB.

(4-8) TotalInsertionEfffectMapNo

TotalInsertionEffectMapNo is a message for informing the mother board of a type of selectable effects if the plug-in board is the insertion effector. For example, if any of vocoder, detune, chordal, and chromatic is selectable as an insertion effect, the total number of these effects (namely 4) is transmitted to the mother board.

(5) First Special Command Group

Of the above-mentioned PB system information, the parameters having a name "TotalNative . . . ParameterNo" indicates the number such as the number of timbres or the number of effects. The first special command group is used for transferring necessary information as a premise of request and reply for specific contents of these timbres and effects.

(5-1) Native SystemParameterInformation

A request for the specific contents of a system parameter from the mother board to a plug-in board is a 1-byte message. Only the parameter number is informed. The minimum value of the parameter number is 0, and the maximum value is return value of TotalNativeSystemParameterNo−1.

If the plug-in board is the insertion effector for executing detune and so on as described in the above-mentioned example, "0" is set if the parameter of melody channel is necessary and "1" is set if the parameter of harmony channel is necessary for example.

Receiving the request for NativeSystemParameterInformation, the plug-in board supplies a 5-byte reply to the mother board. This reply is composed of a 1-byte ModelID, a 1-byte AddressHi, a 1-byte AddressMid, a 1-byte AddressLow, and a 1-byte DataSize.

This reply provides information that becomes necessary when the mother board requests the plug-in board for character information and so on (details will be given in the description of the second special command group). ModelID indicates a model ID to be given in a second special command to be outputted from the mother board. AddressHi, AddressMid, and AddressLow indicate addresses to be given in the second special command. DataSize indicates data size of character information for example to be transmitted as the reply of the second special command from the plug-in board to the mother board.

As described above, the direction identifier indicative of the reply, the model ID (4F), and the address indicative of NativeSystemParameterInformation are attached before the header. Obviously, these attached information is different from ModeID, AddressHi, AddressMid, and AddressLow included in the above-mentioned reply.

(5-2) NativePartParameterInformation and Native EffectParameterInformation

NativePartParameterInformation and NativeEffectParameterInformation are used to capture information about a part parameter and an effect parameter. Like the above-mentioned NativeSystemParameterInformation, a request for the specific contents of these messages from the mother board to the plug-in board is a 1-byte message. A reply from the plug-in board is also a 5-byte message like the reply of NativeSystemParameterInformation.

(5-3) VoiceName

VoiceName is used for query of a timbre name if the plug-in board is the single-part sound source. A request from the mother board to the plug-in board is composed of a total of three bytes of timbre number consisting of MsbNo, LsbNo, and PgmNo, and a 1-byte AsciiDataSize. AsciiDataSize denotes the number of characters (for example, 8) that can be displayed on the main frame side.

On the other hand, the reply from the plug-in board is composed of a 1-byte AsciiDataSize and a variable-length VoiceName. AsciiDataSize has the same number of characters as included in the request. VoiceName is an ASCII code indicative of a timbre name in the range of AsciiDataSize.

(5-4) VoiceMapInfo

VoiceMapInfo is a message for use in query from the mother board to the plug-in board for a timbre map if the plug-in board is the single-part sound source. The request for VoiceMapInfo is a 1-byte message for specifying a map number. This map number is specified in a range of 0 to return value of TotalVoiceMapNo−1.

The reply of VoiceMapInfo is a 34-byte message, composed of 1-byte BankMsbNo, 1-byte BankLsbNo, and 1-byte bit maps Pgm0to3AssignBitMap, Pgm4to7AssignBitMap, . . . , Pgm124to127AssignBitMap. The bit maps Pgm0to3AssignBitMap, . . . , Pgm124to127AssignBitMap represent "1" in the corresponding bit position if the timbre exists in the map specified by BankMsbNo and BankLsbNo, and "0" if the timbre does not exist.

(5-5) BankMsbIconData

BankMsbIconData is a message for use in a query from the mother board to the plug-in board for icon data indicative of bank classification if the plug-in board is the single-part sound source.

The request for BankMsbIconData is a 1-byte message for specifying the above-mentioned BankMsbNo. The reply for the request is 48-byte bit map data indicative of an icon. For example, in the classification of the bank simulating a wind instrument, an icon shaped like the wind instrument is preferably provided.

(5-6) InsEffectMapInfo

InsEffectMapInfo is a message for use in a query from the mother board to the plug-in board for an effect map if the plug-in board is the insertion effector. The request of InsEffectMapInfo is a 1-byte message for specifying a map number. This map number is specified in a range of 0 to return value of TotalInsertionEffectMapNo−1.

The reply to InsEffectMapInfo is a 7byte message composed of 1-byte TypeLsb, 1-byte Prm1to10Type, 1-byte Prm1to4SupportMap, 1-byte Prm5to8SupportMap, 1-byte Prm9to12SupportMap, and 1-byte Prm13to16SupportMap. Like the above-mentioned BankMsbNo and BankLsbNo, TypeMsb and TypeLsb indicate an effect type and a serial number of the type. Prm1to4SupportMap, Prm5to8SupportMap, Prm9to12SupportMap, and Prm13to16SupportMap represent "1" in the corresponding bit position if the effects 1 through 16 exist, and "0" if they do not exist.

(6) Second Special Command Group

The second special commands are used to obtain information from plug-in boards by use of a result of the reply from the above-mentioned first special commands mainly with respect to various parameters not recognized by the mother board. In the second special command group, the direction identifiers of reply and request are different from one command to another. Namely, the requests of ParameterName, ParameterInfo, ParameterSupportInfo, RelativeParameter, and AbsoluteParameter are represented by codes "00", "01", "02", "03", and "04", respectively. The replies are represented by codes "40", "41", "42", "43", and"44", respectively.

(6-1)

ParameterName is a command for use in informing from the plug-in board to the mother board of a parameter name. In the request for ParameterName, the message is 0 byte long. This is because the name of the corresponding parameter is identified by a special command identifier indicative of the second special command group, a direction identifier indicative of request (00), a model ID (equal to the ModelID contained in the reply of NativeSystemParameterInformation), and address information (equal to AddressHi, AddressMid, and AddressLow contained in the reply). The reply of ParameterName is composed of 1-byte DataSize and a parameter name which is variable-length ASCII data. DataSize indicates a data size (the number of characters) of the ASCII data. For example, if the plug-in board is the insertion effector and detune is specified as address information, a character string Detune Type may be returned.

(6-2) ParameterInfo

ParameterInfo is a command for inquiring by the mother board to the plug-in board for a parameter value. In the request (01) of ParameterInfo, the message is 0 byte long. The reason is the same as that of ParameterName. The reply of ParameterInfo is composed of 1-byte DataSize, 1-byte numeric data MaxValue, 1-byte numeric data MinValue, and 1-byte numeric data DefaultValue. DataSize indicates a data size for each of these pieces of numeric data. MaxValue, MinValue, and DefaultValue indicate the maximum value, the minimum value, and the default value of each parameter, respectively.

(6-3) ParameterSupportInfo

ParameterSupportInfo is a command for indicating whether a parameter supported by the mother board is also supported by the plug-in board. Namely, this command is used for checking whether the plug-in board can cope with the parameters supported by the mother board when the plug-in board receives a dump request or a parameter request. The message of the request for ParameterSupportInfo is 1-byte long. If this message is "0", it indicates the parameter request; if "1", it indicates the dump request. The corresponding reply from the plug-in board is also 1-byte long. If the reply is "0", it indicates that the plug-in board cannot cope with the parameters supported by the mother board; if"1", it indicates that the plug-in board can cope with them.

(6-4) RelativeParameter

RelativeParameter is a command for obtaining information at the time when a parameter in the plug-in board has changed relative to the current value. The message of the request for RelativeParameter is 3-byte long, composed of 1-byte RelativeData, 1-byte ReplyDataSize, and 1-byte DisplayDataSize. RelativeData indicates a change value (for example, +1 or −1) relative to the current value of a parameter. ReplyDataSize indicates a display data size of a changed parameter (numeric value). DisplayDataSize indicates a display data size of a changed parameter (character). The reply to RelativeParameter is composed of 1-byte DataSize, Data (numeric data) of the length indicated by DataSize, 1-byte DisplayDataSize, and DisplayData (character data) of the length indicated by this DisplayDataSize.

(6-5) AbsoluteParameter

AbsoluteParameter is a command for obtaining information at the time when a parameter in the plug-in board has changed absolutely. The message of the request for AbsoluteParameter is 3-byte long, composed of 1-byte AbsoluteData, 1-byte of ReplyDataSize, and 1-byte of DisplayDataSize. AbsoluteData indicates a currently changed value of the parameter. ReplyDataSize and DisplayDataSize are the same as those in the above-mentioned RelativeParameter. The reply to AbsoluteParameter is composed of 1-byte of DataSize, Data (numeric data) of data length indicated by this DataSize, 1-byte of DisplayDataSize, and DisplayData (character data) of data length indicated by this DisplayDataSize.

4. Operation of Preferred Embodiment

4.1 Initialization (1) Overall Initialization

Figure 5:
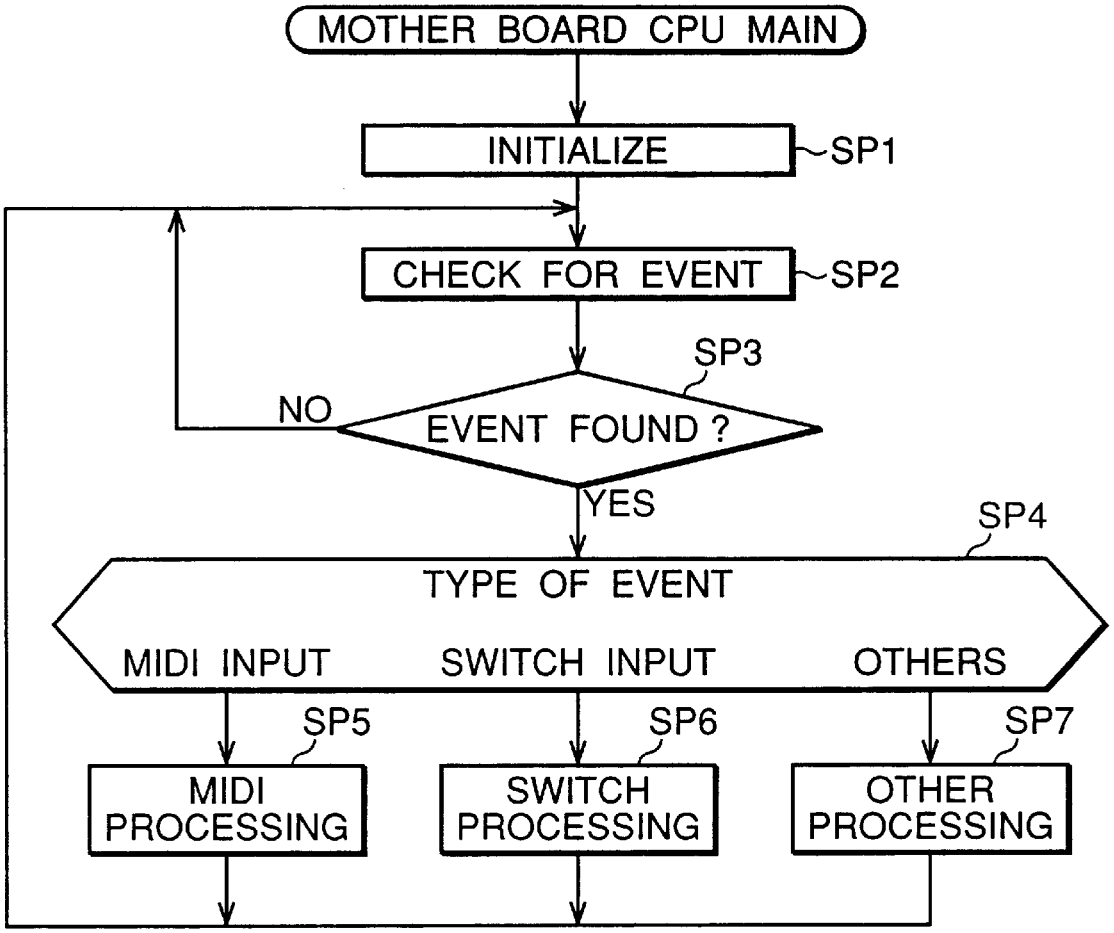
FIG. 5 is a flowchart indicative of a control program executed in the above-mentioned preferred embodiment.

The following describes the operation of the present preferred embodiment. First, when the electronic musical instrument is powered on, a program shown in FIG. 5 is started in the mother board 100 by means of the CPU 101. In the Figure, an initializing operation is executed in step SP1. To be specific, the communication mode is set to mode 2 and MotherDisplayLevel is sent to all plug-in boards. Each plug-in board stores MotherDisplayLevel, thereby limiting, as required, the length of a character string to be transmitted to the mother board.

Then, the communication mode is switched to mode 1 and DeviceNo for setting device number "1" is transmitted to the plug-in board 191 inserted in the connector 121. Based on this DeviceNo, the plug-in board 191 stores device number "1" and outputs PbType and PbIconData, thereby informing the CPU 101 of the type and so on of the plug-in board 191. Namely, the CPU 101 recognizes the type of the plug-in board 191 by PbTypeMsb, the minor classification (sound source scheme and so on) by PbTypeLsb, and the version by VersionNo. The recognized data is stored in the RAM 103. The icon data specified by PbIconData is also stored in the RAM 103.

Next, the plug-in board 191 informs the CPU 101 of TotalNativeSystemParameterNo if system parameters exist, TotalNativePartParameterNo if part parameters exist, and TotalNativeEffectParameterNo if effect parameters exist.

If the plug-in board 191 is the single-part sound source, the plug-in board 101 informs the CPU 101 of SinglePartTgParameterBaseAddress and TotalVoiceMapNo. If the plug-in board 191 is the insertion effector, the plug-in board 191 informs the CPU 101 of TotalInsertionEffectMapNo and InsertionEffectParameterBaseAddress. If the plug-in board 191 is the system effector, the plug-in board 191 informs the CPU 101 of SystemEffectParameterBaseAddress. Thus, the CPU 101 recognizes the number of various parameters of the plug-in board 191 and a base address, which are stored in the RAM 103.

Device numbers "2", "3", and so on are sent to the plug-in boards 192 through 199 in the same manner as above. The PbType, the number of parameters that can be edited, and the base address of each of these plug-in boards are stored in the RAM 103. Therefore, the RAM 103 stores the type, the minor classification, the version number, and the number of parameters that can be edited of each of these plug-in boards.

Then, an initial menu screen having character strings shown below is displayed on the display device 160. It should be noted that, in the initial state, a cursor is positioned to "1: SET PART". Namely, "1: SET PART" is highlighted in reverse display mode or negative mode.

<<INITIAL SCREEN>>

1: SET PART

2: SET INSERTION EFFECT

3: SET SYSTEM EFFECT

4: EDIT SIGNAL FLOW (2) Altering a Timbre Map of Main Frame

As described above, in the timbre mapping of XG standard, up to 4×128×128=65,536 types of timbres can be mapped. However, if the variations represented by the bank select LSB is limited to one set, the number of selectable melody timbres (the bank select MSB=0) becomes 128, which is the same as the number of program changes.

The kinds of program changes supported by the mother board 100 is stored in the ROM 102. In the initialization, the contents of the ROM 102 are transferred to the RAM 103. The contents transferred to the RAM 103 are called a main frame timbre mapping.

In the main frame timbre mapping, each program change is related to one byte. For the program changes supported by the mother board 100, 127 is labeled; for the selectable timbres not supported, 0 is labeled. For the program changes supported by the plug-in board, the device number 1 to 16 and the map number 1 to 16 of that plug-in board are stored. However, in the initial state, it is not determined which plug-in board supports which program change, hence all bytes are set to 127 or 0.

If a timbre associated with the same program change is supported by both the mother board 100 and the plug-in board, it is necessary to determine which timbre is to be employed. Generally, in order to prevent the price of the main frame of electronic musical instruments from getting higher, the mother board 100 synthesizes music tones by standard performance, while the plug-in board is sold to provide an optional capability to execute high-performance music tone synthesis. Therefore, if the program changes supported by the mother board and the plug-in board overlap, the timbres on the plug-in board side are preferred.

To be more specific, sounding of the program changes commonly supported by the plug-in board is suppressed on the side of the mother board 100 by writing the device number of the plug-in board at the corresponding position of the main frame timbre map. The following describes this processing in detail. First, if the plug-in board is the single-part sound source, the CPU 101 has been informed of TotalVoiceMapNo. The CPU 101 specifies each map number 0 to TotalVoiceMapNo−1, and sends the request for VoiceMapInfo to the plug-in board. In response, the reply of VoiceMapInfo is returned from the plug-in board to the CPU 101. The CPU 101 determines whether BankMsbNo in this reply is 0 or not. If BankMsbNo is found other than 0, the main frame timbre map is not edited. On the other hand, if BankMsbNo in the reply is found 0, the device number and map number of the plug-in board are written to the position corresponding to the program change with one of the bit maps Pgm0to3AssignBitMap, . . . , Pgm124to127AssignBitMap in the storage location of 128 bytes specified by BankLsbNo set to 1. When this processing has been executed on all single-part sound sources, it is recognized and memorized whether each program is supported or not and, if supported, the corresponding board (the mother board 100 or any of the plug-in boards) is memorized.

4.2 Setting a Part (1) Specification of Part Setting Referring to FIG. 5 again, it is determined, in step SP2, whether an event for executing the processing has occurred. The event herein denotes the input of a MIDI signal through the MIDI input terminal 118 or the operation of a switch on the operator panel switch 150, by way of example. Next, in step SP3, it is determined whether an event has occurred or not. If no event is found occurring, the processing is held in a wait state in steps SP2 and SP3.

When the enter key is pressed on a numeric keyboard of the operator panel switch 150, an event is detected in step SP2. The decision is YES in step SP3. In step SP4, the processing branches according to the detected event.

Because the detected event is of the operator panel switch 150, the processing goes to step SP6, in which SW processing corresponding to the event is executed. In the above-mentioned example, the enter key is pressed when the cursor is positioned to "1: SET PART" in the initial screen, so that part setting is specified. It should be noted that "1: SET PART" denotes alteration of any part in the music tone generator 108 or the multi-part sound source (plug-in board).

(2) Displaying Parts

Editing a part requires the user to specify the part to be edited. Further, before the specification, it is required to display the parts that can be specified for selection by the user. The parts that can be specified only in the mother board 100 are the first part through 16th part implemented by the music tone generator 108 and an AD part inputted from the A/D converter 109, amounting to a total of 17 parts. It will be convenient if each part of the multi-part sound source can be specified. Therefore, the CPU 101 displays the default state of each part on the mother board 100 and the icons and names of the multi-part sound source onto the display device 160 as shown below for example.

<<SELECT PART>>

0: RETURN TO INITIAL SCREEN
1: (BUILT-IN) ACOUSTIC GRAND PIANO
2: (BUILT-IN) HONKY-TONK PIANO
3: (BUILT-IN) CELESTA
4: (BUILT-IN) MARIMBA
15: (BUILT-IN) SITAR
16: (BUILT-IN) AGOGO (3) Specifying Part to be Edited When the user presses "2" of the numeric keyboard, the processing goes to step SP6 from steps SP3 and SP4. In step SP6, inputted number "2" is displayed on the display device 160. Further, when the user presses the enter key, the processing goes to step SP6 again, in which it is determined that the second part has been specified as the part to be edited. If a part number is of two digits or more, the user may consecutively press numeric keys "1" and "5" for example, and then press the enter key to establish the input.

(4) Displaying a Timbre Group

Next, it is required to specify a timbre for the part to be edited. Since there are a great number of types of timbres, the timbres are classified into plural groups, one of which is specified first. Therefore, the following screen is displayed on the display device 160.

<<SELECT GROUP>>

0: RETURN TO PART SELECT SCREEN
1: PIANO GROUP
2: CHROMATIC PERCUSSION GROUP
3: ORGAN GROUP
4: GUITAR GROUP
19: PERCUSSIVE GROUP
20: EFFECT SOUND

At this moment, the cursor is positioned to the group corresponding to the timbre selected before. In the above-mentioned example, the second part has been set to "HONKY-TONK PIANO", so that the cursor is positioned to "1: (BUILT-IN) PIANO GROUP".

(5) Displaying a Timbre Name and so on

When the user specifies a group number 1 to 20, the main frame timbre map is referenced for the program change belonging to the specified group. If the value "127" is stored at the corresponding position in the main frame timbre map, the timbre name and so on of this program change is stored in the ROM 102, so that these contents are read therefrom. On the other hand, if the device number and map number of the plug-in board are stored in the main frame timbre map, the request for VoiceMapInfo is sent to this plug-in board along with the map number. When the reply is returned, bank select MSB and bank select LSB are recognized by the CPU 101 based on BankMsbNo and BankLsbNo included in this reply.

Next, the request for VoiceName is sent from the CPU 101 to the plug-in board with the recognized bank select MSB being MsbNo, the bank select LSB being LsbNo, the program change being PgmNo, and the maximum number of display characters (for example, 20) of the timbre name in the display device 160 being AsciiDataSize. In response, AsciiDataSize below 20 and the ASCII data of the timbre name having the number of characters indicated by AsciiDataSize are returned from the plug-in board.

Thus, when the timbre name provided by the mother board 100 or the timbre name implemented by the plug-in board is obtained, the contents of the obtained timbre name are displayed on the display device 160 as shown below.

<<SELECT TIMBRE>>

0: RETURN TO TIMBRE GROUP SELECT SCREEN

*1: ACOUSTIC GRAND PIANO

*2: BRIGHT ACOUSTIC PIANO

3: ELECTRIC GRAND PIANO

4: HONKY-TONK PIANO

5: ELECTRIC PIANO 1

6: ELECTRIC PIANO 2

7: HARPSICHORD

8: CLAVI

In the above-mentioned example, each position marked by asterisk (*) actually displays, based on PbIconData, an icon of the plug-in board which is a single-part sound source. Namely, in the above-mentioned example, "ACOUSTIC GRAND PIANO" and "BRIGHT ACOUSTIC PIANO" are implemented by the plug-in board. The user can immediately recognize which program change is treated by the plug-in board by viewing the display screen on the display device 160.

At this moment, the cursor is positioned to the timbre name of the timbre selected before. In the above-mentioned example, the timbre has been previously set to "HONKY-TONK PIANO", so that the cursor is set to "4: HONKY-TONK PIANO". If the user specifies a timbre name 1 to 8, the specified timbre is set as the timbre of the second part to be edited. Thus, the user can specify the timbre for the desired part. It should be noted that, when the user presses "0" of the numeric keyboard in each display screen shown above, the menu one step higher level is displayed again.

4.3.2 Setting an Insertion Effect

In the above-mentioned initial screen, if "2: SET INSERTION EFFECT" is selected, a list of insertion effects is displayed on the display device 160 as shown below. The list of insertion effects includes a plug-in board for which "2" (insertion effect) has been returned as PbType, in addition to the built-in insertion effects.

<<2: SET INSERTION EFFECT>>

0: RETURN TO INITIAL SCREEN

1: BUILT-IN INSERTION EFFECT

*2: (SINGLE IE) HM21P HARMONIC PART GENERATING BOARD VER. 1.00

In the above-mentioned display example, the icon of the plug-in board obtained in the initialization is displayed at the position marked by asterisk (*). Character string "(SINGLE IE)" is displayed based on the type indicated by PbTypeMsb. Character string "HM21P" is displayed based on PbName. Character string "HARMONIC PART GENERATING BOARD" is displayed based on PbTypeLsb. Character string "VER. 1.00" is displayed based on VersionNo. When the above-mentioned screen has been displayed, the cursor is positioned to "BUILT-IN INSERTION EFFECT".

When the user presses "1" of the numeric key board and then the enter key, "1: BUILT-IN INSERTION EFFECT" is selected. Pressing a numeric key and then the enter key is hereafter simply referred to as "selecting". As a result of this selection, a list of various parameters associated with the built-in insertion effect is displayed on the display device 160. The user can edit these parameters. It should be noted that these operations are the same as those executed on a known electronic musical instrument.

On the other hand, the operation to be executed when the user selects a plug-in board is also one of the features of the present preferred invention. The following describes this point in detail. First, as described above, if the plug-in board is an insertion effector, the mother board 100 is informed of TotalInsertionEffectMapNo at the initialization. The CPU 101 specifies each map number 0 to TotalInsertionEffectMapNo−1, and sends the request for InsEffectMapInfo to the plug-in board.

In response, the plug-in board returns the reply of InsEffectMapInfo to the CPU 101 as described before. Prm1to4SupportMap, . . . , Prm13to16SupportMap included in this reply indicate whether an effect 1 to 16 exists or not as described before. The address corresponding to each effect is uniquely determined based on the base address (InsertionEffectParameterBaseAddress) of the plug-in board, TypeMsb and TypeLsb in the reply of InsEffectMapInfo, and the effect number 1 to 16.

Then, the request for ParameterName is sent from the CPU 101 to the plug-in board along with this determined address. The reply returned in response includes ASCII data indicative of the parameter name. Likewise, along with the address determined before, the request for ParameterInfo is sent from the CPU 101 to the plug-in board. The reply returned in response includes MaxValue, MinValue, and DefaultValue indicative of the maximum value, the minimum value and the default value, respectively. Based on the information thus obtained, the following screen is displayed on the display device 160.

<<* SET HM21P HARMONIC PART GENERATING BOARD>>

0: RETURN TO INSERTION EFFECT SETTING SCREEN

1: INTENSITY OF HARMONY (0 TO +127) CURRENT VALUE: 10

2: DEPTH OF HARMONY (0 TO +127) CURRENT VALUE:

3: SET RESULT TO BOARD

In the above-mentioned example, character strings "INTENSITY OF HARMONY" and "DEPTH OF HARMONY" are displayed by displaying the ASCII data in the reply of ParameterName as it is. In the above example, the contents of both are "(0 TO +127) CURRENT VALUE: 10", where 0 is MinValue, +127 is MaxValue, and 10 is DefaultValue returned from the plug-in board.

If the user selects "2: DEPTH OF HARMONY . . . ", the cursor is positioned to the selection. If the user presses the increment key on the operator panel switch 150, the request for RelativeParameter is sent to the plug-in board. At this moment, +1 is specified as RelativeData. The plug-in board obtains the value 11 resulted from incrementing the current value 10 of the DEPTH OF HARMONY by 1.

In the reply of RelativeData, the calculation result 11 is returned as Data. Consequently, "CURRENT VALUE: 10" to which the cursor is positioned on the display device 160 is changed to "CURRENT VALUE: 11". Conversely, if the decrement key is pressed on the operator panel switch 150, the value "−1" is specified as RelativeData and a result obtained by subtracting 1 from the current value is returned from the plug-in board.

In this stage, the plug-in board only returns the result of incrementing or decrementing the current value, and therefore the parameter itself in the plug-in board has not been altered yet. In order to set the result of alteration to the plug-in board, the user selects "3: SET RESULT TO BOARD".

When the above-mentioned operation is executed, the parameter change associated with the parameter to be altered is sent to the plug-in board along with the altered value (the value displayed on the display device 160). Then, based on this parameter change, the parameter is altered in the plug-in board.

4.4 Setting Other Parameters

So far, the method of setting parameters to the plug-board, which is an insertion effector, has been described in detail. Parameter setting is executed in the same manner with respect to other plug-in boards such as a single-part sound source, a multi-part sound source, and a system effector.

Namely, ASCII data about parameters to be set is sent from the plug-in board to the mother board 100, so that the names of those parameters which have not been supported at the time of designing the mother board 100 can also be displayed without changing the software of the mother board 100. In altering parameter values, variable +1 or −1 is sent from the mother board 100 as RelativeData to the plug-in board. The calculation itself for altering the current value of the parameter is executed by the plug-in board. The result of the calculation is returned to the mother board 100. This indicates that the plug-in board can determine the method of calculating RelativeData. For example, if it is preferable to set a parameter in an exponential manner, a larger increment or decrement at time may be set as the current value gets larger. If a parameter value is to be limited, proper processing may be set according to the nature of that parameter. The calculation method can be determined by programming in any desired way by the plug-in board independently of the mother board.

4.5 Editing Signal Flow (1) Assigning an Insertion Effect

When "4: EDIT SIGNAL FLOW" is selected in the initial screen, a signal flow editing screen listing the following character strings is displayed as shown below.

<<SIGNAL FLOW EDITING SELECT SCREEN>>

0: RETURN TO INITIAL SCREEN

1: ASSIGN INSERTION EFFECT

2: ASSIGN GROUP

3: ASSIGN SYSTEM EFFECT

If the user selects "ASSIGN INSERTION EFFECT", a screen shown below is displayed, in which the name of each insertion effect and a part number to which this insertion effect is assigned are displayed. In the screen example shown below, all insertion effects are assigned to some part; however, if an insertion effect is not assigned to any part, "PART NUMBER: (NONE)" is displayed.

<<INSERTION EFFECT ASSIGNMENT SCREEN>>

0: RETURN TO SIGNAL FLOW EDITING SELECT SCREEN

1: BUILT-IN INSERTION EFFECT PART NUMBER: 1

*2: (SINGLE IE) HM21P HARMONIC PART GENERATING BOARD VER. 1.00 PART NUMBER: 3

If the user selects "1: BUILT-IN INSERTION EFFECT", a screen shown below is displayed on the display device 160.

SPECIFY PART TO WHICH BUILT-IN INSERTION EFFECT IS ASSIGNED

0: ASSIGN TO NO PART

1 TO 16: NUMBER OF PART TO WHICH ASSIGNMENT IS MADE (CURRENTLY ASSIGNMENT IS MADE TO FIRST PART)

If the user specifies a part number, the part number to which the insertion effect is to be assigned is set according to the content of the specification. The above-mentioned screen is displayed again with the content of the setting reflected. Namely, if the user selects "5", "PART NUMBER: 1" is changed to "PART NUMBER: 5" in the above-mentioned INSERTION EFFECT ASSIGN screen. Thus, the user is free to set a part to which an built-in insertion effect or an insertion effect provided by the plug-in board is to be assigned.

(2) Assigning a Group

If the user selects "2: ASSIGN GROUP" in the SIGNAL FLOW EDITING SELECT screen, a screen shown below is displayed on the display device 160.

<<GROUP ASSIGN SCREEN>>
0: RETURN TO SIGNAL FLOW EDITING SELECT SCREEN

| | G1 | G2 | G3 | G4 |
|---|---|---|---|---|
| 1ST PART: | 99 | 0 | 127 | 0 |
| *2ND PART: | 90 | 0 | 10 | 0 |
| 3RD PART: | 0 | 64 | 64 | 0 |
| 4TH PART: | 0 | 0 | 0 | 0 |
| . | | | | |
| . | | | | |
| . | | | | |
| 16TH PART: | 0 | 0 | 0 | 0 |
| AD PART: | 0 | 64 | 64 | 0 |
| 1ST GROUP: | — | 64 | 64 | 0 |
| 2ND GROUP: | 0 | — | 64 | 0 |
| 3RD GROUP: | 0 | 0 | — | 0 |
| 4TH GROUP: | 0 | 0 | 0 | — |

In the above-mentioned screen, the laterally arranged G1 through G4 indicate the first through fourth groups (refer to FIGS. 3 and 4). The vertically arranged first part through the fourth group indicate input signals for these four groups. Each numeric value (0 to 127) at each intersection indicates a volume value. The contents of the above-mentioned screen correspond to the signal flow shown in FIG. 3. For example, as shown in FIG. 3, a first-part tone signal and a second-part tone signal are inputted in the first group (the mixer 206) through the built-in insertion effector, so that values higher than 1 are entered in the rows of the first part and the second part, while the remaining rows being set to 0.

In the example shown in FIG. 3, the fourth group does not exist from the beginning, so that the intersections with the lateral G4 and the intersection with the vertical fourth group are all set to 0s. Also, as shown in FIG. 3 and the above-mentioned screen, each group can receive tone signals (if the system effector is installed, tone signals coming through this system effector) outputted from other groups.

At this moment, the cursor is positioned at the intersection between G1 and the first part. When the user operates the cursor key, the cursor moves along horizontally or vertically. When the user operates the increment/decrement key, the volume value is incremented or decremented.

If a multi-part sound source (for example, the 16-part sound source 253 shown in FIG. 4) exists on the plug-in board, a line such as "*MULTI-PART SOUND SOURCE: 0 0 0 87" is inserted between "AD PART: . . . " and "1ST GROUP: . . . " in the above screen.

(3) Assigning System Effects

In the SIGNAL FLOW EDITING SELECT screen shown above, if the user selects "3: ASSIGN SYSTEM EFFECT", the following screen is displayed on the display device 160. System effects are assigned to groups like the assignment of insertion effects to parts.

<<SYSTEM EFFECT ASSIGN SCREEN>>

0: RETURN TO SIGNAL FLOW EDITING SELECT SCREEN

1: BUILT-IN SYSTEM EFFECT (CHORUS)
GROUP NUMBER: 1

2: BUILT-IN SYSTEM EFFECT (REVERBERATION)
GROUP NUMBER: 2

*3: THREE-DIMENSIONAL PANNING EFFECT BOARD DBT0023P (CONCERT HALL)
GROUP NUMBER: 3

4: BUILT-IN LAST STAGE EQUALIZER (THRU)
GROUP NUMBER: 4

Thus, the user can make setting to assign the built-in sound source (the music tone generator 108) or the single-part sound source of the plug-in board to each part. The user is also free to assign insertion effects to these parts. Moreover, the user can determine the connection relationships of mixers constituting each group and the system effects to be inserted in each group. Thus, the user is free to set the signal flows or the algorithm of the tone synthesis as shown in FIGS. 3 and 4.

4.6 MIDI Processing

Now, referring to FIG. 5 again, when a MIDI signal is inputted in the loop of steps SP2 and SP3, the processing goes to step SP5 through step SP4. In step SP5, processing such as sounding or muting is executed based on the inputted MIDI signal. However, if the value "127" is not set for the timbre (program change) associated with note-on/note-off at the corresponding position in the main frame timbre map, no sounding processing is executed. Namely, although the timbre can be handled by the mother board 100, if it is supported by the plug-in board of a single-part sound source, the sounding processing is prohibited in the mother board. In this case, this MIDI signal is directly supplied to the plug-in board through the photocoupler 117 and the connectors 121 through 129, so that the tone signal is synthesized in this plug-in board and the synthesized tone signal is supplied to the mixer 106 through the serial I/O port 107. Thus, according to the present preferred embodiment, whether sounding is enabled or disabled in the mother board 100 is determined based on the main frame timbre map, thereby preventing the duplicate sounding of a tone signal in both the mother board 100 and the plug-in board 191 to 199.

5. Variations

While the preferred embodiments of the present invention have been described using specific terms, such description is for illustrative purposes only, and it is to be understood that changes and variations may be made without departing from the spirit or scope of the appended claims. For example, in the above-mentioned preferred embodiment, the type (PbType) of each plug-in board is determined immediately after the power-on sequence (step SP1). Alternately, the detection of PbType may be made after a new plug-in board is inserted or periodically with a predetermined time interval.

Lastly, referring back to FIG. 1, according to the first aspect of the invention, the machine readable medium or the disk 180 is provided for use in operating the electronic musical instrument constructed on the mother board 100 having the CPU 101, the input port 118, the internal sound source 108 and the connector 191 in response to performance information to generate a music tone having a desired timbre according to timbre setting information. The machine readable medium contains program instructions executable by the CPU 101 for causing the electronic musical instrument to perform the operation comprising the steps of providing the performance information from an external source to the input port 118, setting a music tone parameter based on the timbre setting information, driving the internal sound source 108 according to the music tone parameter to generate a first music tone in response to the performance information provided to the input port 118, detecting that the connector 121 receives the extension board 191 having an external sound source, and providing the timbre setting information to the extension board 191 through the connector 121 to remotely set the music tone parameter of the external sound source according to the timbre setting information so that the external sound source can generate the second music tone.

The machine readable medium 180 may be for use in operating the electronic musical instrument having the CPU 101 to edit a parameter necessary for generating a music tone by the extension board 191 or 199 coupled to the mother board 100 of the electronic musical instrument while monitoring the parameter according to display information. The machine readable medium contains program instructions executable by the CPU 101 for causing the electronic musical instrument to perform the operation comprising the steps of memorizing a current value of the parameter in the extension board 191 or 199 used for generating the music tone, displaying the current value of the parameter to be edited on the display device 160 provided in the electronic musical instrument according to the display information transmitted from the extension board 191 or 199 to the mother board 100, inputting an operational variable effective to change the current value of the parameter into the mother board 100, transmitting the operational variable from the mother board 100 to the extension board 191 or 199, updating the current value of the parameter memorized in the extension board when the operational variable is transmitted from the mother board 100 to the extension board 191 or 199, and retransmitting the display information indicative of the updated value of the parameter from the extension board 191 or 199 to the mother board 100 so as to display the updated value of the parameter on the display device 160.

The machine readable medium 180 may be for use in operating the electronic musical instrument constructed on the mother board 100 having the CPU1O1, the input port 118, the sound source 108 and the connector 129 in response to performance information for generating a music tone having a desired effect according to effect setting information. The machine readable medium contains program instructions executable by the CPU 101 for causing the electronic musical instrument to perform the operation comprising the steps of inputting the performance information from an external source to the input port 118, driving the sound source 108 to generate the music tone in response to the performance information provided from the input port 118, detecting if the connector 129 receives the extension board 199 which can be set with an effect parameter for imparting an effect to the music tone generated by the sound source 108, and providing effect setting information to the extension board 199 through the connector 129 for remotely setting the effect parameter of the extension board 199.

According to the second aspect of the invention, the machine readable medium 180 may be for use in operating the electronic musical instrument having the CPU 101, the main sound source 108 and an extension sound source of the extension board 191 in response to performance information for generating a music tone having a selected timbre. The machine readable medium contains program instructions executable by the CPU 101 for causing the electronic musical instrument to perform the operation comprising the steps of driving the main sound source 108 in response to the performance information for generating a first music tone having a timbre selected from a plurality of different timbres pre-installed in the main sound source 108, driving the extension sound source 191 in response to the performance information for generating a second music tone having a timbre selected from a plurality of different timbres pre-installed in the extension sound source 191, providing the performance information concurrently to both of the main sound source 108 and the extension sound source 191 so as to generate the first music tone and the second music tone in parallel to each other, and controlling the main sound source 108 to inhibit generation of the first music tone while allowing the extension sound source 191 to generate the second music tone when the selected timbre of the first music tone is identical to the selected timbre of the second music tone.

The machine readable medium 180 may be for use in operating the electronic musical instrument constructed on the mother board 100 having the CPU in response to a performance signal provided from an external source for generating a music tone. The machine readable medium contains program instructions executable by the CPU 101 for causing the electronic musical instrument to perform the operation comprising the steps of inputting the performance signal from the external source to the input port 118 provided on the mother board 100, driving the internal sound source 108 provided on the mother board 100 in response to the performance signal for generating a music tone, passing the performance signal inputted from the input port 118 to the internal sound source 108 through the internal interface 116 provided on the mother board 100, optionally receiving the extension board 191 having an external sound source through the external interface 121 provided on the mother board 100 for generating a music tone in response to the performance signal inputted from the input port 118, and activating the photo-coupler 117 interposed between the input port 118 and both of the internal interface 116 and the external interface 121 for feeding the performance signal concurrently to both of the internal sound source 108 and the external sound source 191 without substantial delay of the performance signal to thereby enable concurrent generation of the music tones by both of the internal sound source 108 and the external sound source 191.

According to the third aspect of the invention, the machine readable medium 180 may be for use in operating the electronic musical instrument constructed on the mother board 100 having the CPU 101 for synthesizing a music tone by means of audio modules assembled according to a synthesis algorithm. The machine readable medium contains program instructions executable by the CPU 101 for causing the electronic musical instrument to perform the operation comprising the steps of providing one or more of internal audio module comprised of the tone generator 108, the mixer 106 and the DSP 104 in the mother board 100, detecting when the connector 191 or 199 provided in the mother board 100 optionally receives therein the extension board 191 or 199 having one or more of external audio module, notifying identification information identifying the external audio module owned by the extension board 191 or 199 to the mother board 100, and assembling altogether one or more of the internal audio module and one or more of the external audio module identified by the identification information so as to set the synthesis algorithm by which the music tone is synthesized.

As described and according to the first aspect of the present invention, the parameters of the extension boards can be set based on predetermined standards. In addition, the current values of parameters can be modified by the controller of the extension board based on the information inputted by the user, so that the controller of the mother board need not be aware of the method of the modification of the extension board. This ensures to make the most of the extension board or plug-in board in various situations.

Further, according to the second aspect of the invention, the same performance information is supplied to the sound sources of both the mother board and the plug-in board. At the same time, for a timbre that can be sounded by both of the mother board and the plug-in board, the generation of the tone signal for that timbre is suppressed on the mother board. This allows the sound sources of the mother board and the plug-in board to generate music tones with appropriate timings. In addition, performance information can be promptly supplied to the extension board through the photo-coupler and plural connection terminals, also ensuring the generation of music tones with appropriate timings.

Still further, according to the third aspect of the invention, the mother board receives a signal for identifying type of each extension board from the extension board inserted in the connector of the main frame, and sets a tone generating algorithm according to the contents of the received signal. This allows automatic setting according to the capabilities of the inserted plug-in board, thereby enhancing the general versatility of the extension slots and the degree of freedom of the music tone generating algorithm.

What is claimed is:

1. A music apparatus constructed on a mother board and responsive to performance information for generating a music tone having a desired timbre according to timbre setting information, the music apparatus comprising:

an input terminal that is provided for inputting performance information;

a control circuit disposed on the mother board and being operative when the timbre setting information is provided for setting a music tone parameter based on the timbre setting information;

a first sound source disposed on the mother board and being operative based on the music tone parameter which is set by the control circuit for generating a first music tone when the performance information is inputted through the input terminal;

a connector provided on the mother board for optionally receiving an extension board having a second sound source for generating a second music tone; and a detector provided on the mother board for detecting the presence of an extension board received by the connector, the extension board having addresses of music tone parameters, wherein the control circuit can operate in case that the extension board is inserted into the connector for providing the timbre setting information to the detected extension board through the connector while specifying an address of a particular music tone parameter for remotely setting the particular music tone parameter in the specified address of the second sound source according to the timbre setting information so that the second sound source can generate the second music tone.

2. The music apparatus according to claim 1, wherein the control circuit provides identification information indicative of a type of the timbre setting information to the extension board through the connector so that the second sound source can recognize the timbre setting information, and then provides the timbre setting information to the extension board.

3. The music apparatus according to claim 1, further comprising a display device that displays the music tone parameter to be set according to the timbre setting information, and that displays an identification symbol indicative of whether or not the displayed music tone parameter is to be set to the second sound source.

4. An edit apparatus for editing a parameter necessary for generating a music tone while monitoring the parameter according to display information, the edit apparatus comprising:

a display device provided for displaying a current value of the parameter to be edited;

an input device operable for inputting an operational variable effective to change the current value of the parameter;

a first control circuit operative when receiving the display information for controlling the display device to update the current value of the parameter, and being operative when the operational variable is inputted from the input device for transmitting the operational variable; and a second control circuit memorizing the current value of the parameter for generating the music tone, and being operative when the operational variable is transmitted from the first control circuit for updating the current value of the parameter and for transmitting the display formation indicative of the updated value of the parameter to the first control circuit so that the first control circuit can control the display device to display the updated value of the parameter.

5. The edit apparatus according to claim 4, wherein the first control circuit is mounted in a main frame having the display device and the input device, and wherein the second control circuit is mounted on an extension board which is communicably connectable to the main frame so that the second control circuit can receive the operational variable from the first control circuit and can transmit the display information to the first control circuit.

6. A music apparatus constructed on a mother board and responsive to performance information for generating a music tone having a desired effect according to effect setting information, the music apparatus comprising:

an input terminal that is provided for inputting performance information;

a control circuit disposed on the mother board and being operative when the effect setting information is provided for setting an effect parameter based on the effect setting information;

a sound source disposed on the mother board and being operative when the performance information is inputted through the input terminal for generating a music tone;

a connector provided on the mother board for optionally receiving an extension board which can be set with the effect parameter for imparting the effect to the music tone generated by the sound source; and a detector provided on the mother board for detecting the presence of an extension board received by the connector, the extension board having addresses of effect parameters, wherein the control circuit can operate in case that the extension board is inserted into the connector for providing the effect setting information to the detected extension board through the connector while specifying an address of a particular effect parameter for remotely setting the particular effect parameter in the specified address of the extension board.

7. A music apparatus responsive to performance information for generating a music tone having a selected timbre, the music apparatus comprising:

a first sound source responsive to the performance information for generating a first music tone having a timbre selected from a plurality of different timbres pre-installed in the first sound source;

a second sound source responsive to the performance information for generating a second music tone having a timbre selected from a plurality of different timbres pre-installed in the second sound source;

an input device that provides the performance information concurrently to both of the first sound source and the second sound source so as to generate the first music tone and the second music tone in parallel to each other; and a control device coupled to the first sound source and being operative when the selected timbre of the first music tone is identical to the selected timbre of the second music tone for controlling the first sound source to inhibit generation of the first music tone while allowing the second sound source to generate the second music tone.

8. The music apparatus according to claim 7, wherein the second sound source informs the control device of a timbre map indicating the timbres pre-installed in the second sound source so that the control device operates according to the timbre map for identifying a common timbre contained in both of the pre-installed timbres of the first sound source and the pre-installed timbres of the second sound source to thereby control the first sound source to inhibit generation of the first music tone when the common timbre is selected therefor.

9. The music apparatus according to claim 7, wherein the second sound source feeds the second music tone generated by the second sound source to the first sound source, and wherein the first sound source mixes the second music tone fed from the second sound source with the first music tone generated by the first sound source so as to acoustically output mixture of the first music tone and the second music tone.

10. The music apparatus according to claim 7, wherein the first sound source is mounted on a mother board together with the input device and the control device, and wherein the second sound source is mounted on an extension board which is optionally connectable to the mother board.

11. A music apparatus constructed on a mother board and responsive to a performance signal provided from an external source for generating a music tone, the music apparatus comprising:

an input terminal that is provided on the mother board for receiving the performance signal from the external source;

an internal sound source provided on the mother board and being responsive to the performance signal for generating a music tone;

an internal interface provided on the mother board for passing the performance signal inputted from the input terminal to the internal sound source;

an external interface provided on the mother board for optionally receiving an extension board having an external sound source for generating a music tone in response to the performance signal inputted from the input terminal; and a photo-coupler interposed between the input terminal and both of the internal interface and the external interface for feeding the performance signal concurrently to both of the internal sound source and the external sound source without substantial delay of the performance signal to thereby enable concurrent generation of the music tones by both of the internal sound source and the external sound source.

12. A music apparatus constructed on a mother board for synthesizing a music tone by means of audio modules assembled according to a synthesis algorithm, the music apparatus comprising:

one or more of internal audio module provided in the mother board;

a connector provided in the mother board for optionally receiving therein an extension board having one or more of external audio module, the extension board being operative when coupled to the mother board for notifying thereto identification information identifying the external audio module owned by the extension board; and a setting device provided in the mother board for assembling altogether one or more of the internal audio module and one or more of the external audio module identified by the identification information so as to set the synthesis algorithm by which the music tone is synthesized.

13. The music apparatus according to claim 12, wherein the extension board notifies the identification information identifying the external audio module as either of a tone generator for generating a music tone and an acoustic effector for imparting an effect to a music tone.

14. The music apparatus according to claim 12, wherein the extension board notifies the identification information identifying the external audio module as either of a simple module designed for treating a single part of the music tone and a complex module designed for treating multiple parts of the music tone.

15. The music apparatus according to claim 12, wherein the setting device assembles altogether the internal and external audio modules including a tone generator for generating the music tone composed of a plurality of music parts, an insertion effector for imparting an effect to a selected one of the music parts, a mixer for mixing selected ones of the music parts to form a group, and a system effector for imparting an effect to the group.

16. A method of operating an electronic musical instrument constructed on a mother board having an input port, an internal sound source and a connector in response to performance information to generate a music tone having a desired timbre according to timbre setting information, the method comprising the steps of:

providing the performance information from an external source to the input port;

setting a music tone parameter based on the timbre setting information;

driving the internal sound source according to the music tone parameter to generate a first music tone in response to the performance information provided to the input port;

detecting that the connector receives an extension board having an external sound source; and providing the timbre setting information to the extension board through the connector to remotely set the music tone parameter of the external sound source according to the timbre setting information so that the external sound source can generate the second music tone.

17. A method of operating an electronic musical instrument to edit a parameter necessary for generating a music tone by an extension board coupled to a mother board of the electronic musical instrument while monitoring the parameter according to display information, the method comprising the steps of:

memorizing a current value of the parameter in the extension board used for generating the music tone;

displaying the current value of the parameter to be edited on a display device provided in the electronic musical instrument according to the display information transmitted from the extension board to the mother board;

inputting an operational variable effective to change the current value of the parameter into the mother board;

transmitting the operational variable from the mother board to the extension board; updating the current value of the parameter memorized in the extension board when the operational variable is transmitted from the mother board to the extension board; and retransmitting the display formation indicative of the updated value of the parameter from the extension board to the mother board so as to display the updated value of the parameter on the display device.

18. A method of operating an electronic musical instrument constructed on a mother board having an input port, a sound source and a connector in response to performance information for generating a music tone having a desired effect according to effect setting information, the method comprising the steps of:

inputting the performance information from an external source to the input port;

driving the sound source to generate the music tone in response to the performance information provided from the input port;

detecting if the connector receives an extension board which can be set with an effect parameter for imparting an effect to the music tone generated by the sound source; and providing effect setting information to the extension board through the connector for remotely setting the effect parameter of the extension board.

19. A method of operating an electronic musical instrument having a main sound source and an extension sound source in response to performance information for generating a music tone having a selected timbre, the method comprising the steps of:

driving the main sound source in response to the performance information for generating a first music tone having a timbre selected from a plurality of different timbres pre-installed in the main sound source;

driving the extension sound source in response to the performance information for generating a second music tone having a timbre selected from a plurality of different timbres pre-installed in the extension sound source;

providing the performance information concurrently to both of the main sound source and the extension sound source so as to generate the first music tone and the second music tone in parallel to each other; and controlling the main sound source to inhibit generation of the first music tone while allowing the extension sound source to generate the second music tone when the selected timbre of the first music tone is identical to the selected timbre of the second music tone.

20. A method of operating an electronic musical instrument constructed on a mother board in response to a performance signal provided from an external source for generating a music tone, the method comprising the steps of:

inputting the performance signal from the external source to an input port provided on the mother board;

driving an internal sound source provided on the mother board in response to the performance signal for generating a music tone;

passing the performance signal inputted from the input port to the internal sound source through an internal interface provided on the mother board;

optionally receiving an extension board having an external sound source through an external interface provided on the mother board for generating a music tone in response to the performance signal inputted from the input port; and activating a photo-coupler interposed between the input port and both of the internal interface and the external interface for feeding the performance signal concurrently to both of the internal sound source and the external sound source without substantial delay of the performance signal to thereby enable concurrent generation of the music tones by both of the internal sound source and the external sound source.

21. A method of operating an electronic musical instrument constructed on a mother board for synthesizing a music tone by means of audio modules assembled according to a synthesis algorithm, the method comprising the steps of:

providing one or more of internal audio module in the mother board;

detecting when a connector provided in the mother board optionally receives therein an extension board having one or more of external audio module;

notifying identification information identifying the external audio module owned by the extension board to the mother board; and assembling altogether one or more of the internal audio module and one or more of the external audio module identified by the identification information so as to set the synthesis algorithm by which the music tone is synthesized.

22. A machine readable medium for use in operating an electronic musical instrument constructed on a mother board having a CPU, an input port, an internal sound source and a connector in response to performance information to generate a music tone having a desired timbre according to timbre setting information, the machine readable medium containing program instructions executable by the CPU for causing the electronic musical instrument to perform the operation comprising the steps of:

providing the performance information from an external source to the input port;

setting a music tone parameter based on the timbre setting information;

driving the internal sound source according to the music tone parameter to generate a first music tone in response to the performance information provided to the input port;

detecting that the connector receives an extension board having an external sound source; and providing the timbre setting information to the extension board through the connector to remotely set the music tone parameter of the external sound source according to the timbre setting information so that the external sound source can generate the second music tone.

23. A machine readable medium for use in operating an electronic musical instrument having a CPU to edit a parameter necessary for generating a music tone by an extension board coupled to a mother board of the electronic musical instrument while monitoring the parameter according to display information, the machine readable medium containing program instructions executable by the CPU for causing the electronic musical instrument to perform the operation comprising the steps of:

memorizing a current value of the parameter in the extension board used for generating the music tone;

displaying the current value of the parameter to be edited on a display device provided in the electronic musical instrument according to the display information transmitted from the extension board to the mother board;

inputting an operational variable effective to change the current value of the parameter into the mother board;

transmitting the operational variable from the mother board to the extension board; updating the current value of the parameter memorized in the extension board when the operational variable is transmitted from the mother board to the extension board; and retransmitting the display information indicative of the updated value of the parameter from the extension board to the mother board so as to display the updated value of the parameter on the display device.

24. A machine readable medium for use in operating an electronic musical instrument constructed on a mother board having a CPU, an input port, a sound source and a connector in response to performance information for generating a music tone having a desired effect according to effect setting information, the machine readable medium containing program instructions executable by the CPU for causing the electronic musical instrument to perform the operation comprising the steps of:

inputting the performance information from an external source to the input port;

driving the sound source to generate the music tone in response to the performance information provided from the input port;

detecting if the connector receives an extension board which can be set with an effect parameter for imparting an effect to the music tone generated by the sound source; and providing effect setting information to the extension board through the connector for remotely setting the effect parameter of the extension board.

25. A machine readable medium for use in operating an electronic musical instrument having a CPU, a main sound source and an extension sound source in response to performance information for generating a music tone having a selected timbre, the machine readable medium containing program instructions executable by the CPU for causing the electronic musical instrument to perform the operation comprising the steps of:

driving the main sound source in response to the performance information for generating a first music tone having a timbre selected from a plurality of different timbres pre-installed in the main sound source;

driving the extension sound source in response to the performance information for generating a second music tone having a timbre selected from a plurality of different timbres pre-installed in the extension sound source;

providing the performance information concurrently to both of the main sound source and the extension sound source so as to generate the first music tone and the second music tone in parallel to each other; and controlling the main sound source to inhibit generation of the first music tone while allowing the extension sound source to generate the second music tone when the selected timbre of the first music tone is identical to the selected timbre of the second music tone.

26. A machine readable medium for use in operating an electronic musical instrument constructed on a mother board having a CPU in response to a performance signal provided from an external source for generating a music tone, the machine readable medium containing program instructions executable by the CPU for causing the electronic musical instrument to perform the operation comprising the steps of:

inputting the performance signal from the external source to an input port provided on the mother board;

driving an internal sound source provided on the mother board in response to the performance signal for generating a music tone;

passing the performance signal inputted from the input port to the internal sound source through an internal interface provided on the mother board;

optionally receiving an extension board having an external sound source through an external interface provided on the mother board for generating a music tone in response to the performance signal inputted from the input port; and activating a photo-coupler interposed between the input port and both of the internal interface and the external interface for feeding the performance signal concurrently to both of the internal sound source and the external sound source without substantial delay of the performance signal to thereby enable concurrent generation of the music tones by both of the internal sound source and the external sound source.

27. A machine readable medium for use in operating an electronic musical instrument constructed on a mother board having a CPU for synthesizing a music tone by means of audio modules assembled according to a synthesis algorithm, the machine readable medium containing program instructions executable by the CPU for causing the electronic musical instrument to perform the operation comprising the steps of:

providing one or more of internal audio module in the mother board;

detecting when a connector provided in the mother board optionally receives therein an extension board having one or more of external audio module;

notifying identification information identifying the external audio module owned by the extension board to the mother board; and assembling altogether one or more of the internal audio module and one or more of the external audio module identified by the identification information so as to set the synthesis algorithm by which the music tone is synthesized.

* * * * *